US009217558B2

(12) United States Patent
Sparing et al.

(10) Patent No.: US 9,217,558 B2
(45) **Date of Patent: *Dec. 22, 2015**

(54) MODULAR ILLUMINATION DEVICE

(75) Inventors: Kurtis J. Sparing, Belgrade, MT (US); Robert A. Kincaid, Bozeman, MT (US); Birten L. Todd, Virginia Beach, VA (US); Thomas M. Gregory, Belgrade, MT (US); Craig Adam Lamb, Bozeman, MT (US); Matt S. Leach, Bremerton, WA (US)

(73) Assignee: Vista Outdoor Operations LLC, Clearfield, UT (US)

( * ) Notice: Subject to any disclaimer, the term of this patent is extended or adjusted under 35 U.S.C. 154(b) by 542 days.

This patent is subject to a terminal disclaimer.

(21) Appl. No.: 12/735,602

(22) PCT Filed: Feb. 2, 2009

(86) PCT No.: PCT/US2009/000659

§ 371 (c)(1),
(2), (4) Date: Feb. 7, 2011

(87) PCT Pub. No.: WO2009/097154

PCT Pub. Date: Aug. 6, 2009

(65) Prior Publication Data

US 2011/0164411 A1 Jul. 7, 2011

Related U.S. Application Data

(60) Provisional application No. 61/063,239, filed on Feb. 2, 2008.

(51) Int. Cl.
*F21V 21/40* (2006.01)
*F21L 4/00* (2006.01)
(Continued)

(52) U.S. Cl.
CPC ..... *F21V 21/406* (2013.01); *F21L 4/00* (2013.01); *F21L 4/027* (2013.01); *F21V 15/01* (2013.01);
(Continued)

(58) Field of Classification Search
CPC ..... F21Y 2101/02; F21Y 2113/005; F21Y 2113/007; F21Y 2105/001; Y10S 362/802; G02B 27/017; G02B 27/0176; F21L 4/027; F21L 4/00; F21V 2101/02; F21V 21/30; F21V 21/406; F21V 23/0421; F21V 23/0414; F21V 23/04; F21V 14/025; F21V 27/005; F21V 29/225; F21V 9/08; F21V 21/0885; F21V 15/01; H05B 33/0803; H05B 33/0815
USPC ..... 362/800, 295, 311.02, 371–372, 265, 362/197, 204–206, 486, 540, 194–196, 202, 362/209, 217.1–217.17
See application file for complete search history.

(56) References Cited

U.S. PATENT DOCUMENTS 6,079,847 A * 6/2000 Nelson ..... 362/205
7,208,932 B1 * 4/2007 Chun ..... 324/72.5
(Continued)

FOREIGN PATENT DOCUMENTS

JP 2000021202 A * 1/2000
JP 2000326789 * 11/2000
(Continued)

*Primary Examiner* — Mary Ellen Bowman
(74) *Attorney, Agent, or Firm* — Shaddock Law Group, PC

(57) ABSTRACT

A modular illumination device having an electronics assembly, an inner body portion extending from a first end to a second end and defining an interior cavity, wherein the inner body portion is formed so as to accept the electronics assembly within the cavity; a head assembly removably attached or coupled to the first end of the inner body portion; a tail cap portion removably attached or coupled to the second end of the inner body portion, wherein the tail cap portion includes a button assembly having a depressible button; and at least one body sleeve extending from a first end to a second end and defining an interior cavity, wherein the body sleeve is formed so as to accept the inner body portion within the cavity of the body sleeve and to be assembled between the head assembly and the tail cap portion.

26 Claims, 21 Drawing Sheets

(51) Int. Cl.

| | |
|---|---|
| ***F21L 4/02*** | (2006.01) |
| ***F21V 15/01*** | (2006.01) |
| ***F21V 23/04*** | (2006.01) |
| ***H05B 33/08*** | (2006.01) |
| *F21V 9/08* | (2006.01) |
| *F21V 21/088* | (2006.01) |
| *F21Y 101/02* | (2006.01) |

(52) U.S. Cl.
CPC ..... *F21V 23/0414* (2013.01); *H05B 33/0803* (2013.01); *H05B 33/0815* (2013.01); *F21V 9/08* (2013.01); *F21V 21/0885* (2013.01); *F21Y 2101/02* (2013.01)

(56) References Cited

U.S. PATENT DOCUMENTS

| | | | | |
|---|---|---|---|---|
| 8,197,085 | B2 * | 6/2012 | Spartano | 362/205 |
| 2004/0095759 | A1 * | 5/2004 | Koch et al. | 362/205 |
| 2005/0237737 | A1 * | 10/2005 | Kim | 362/197 |
| 2005/0265014 | A1 * | 12/2005 | Matsui et al. | 362/5 |
| 2007/0247839 | A1 * | 10/2007 | Matthews et al. | 362/205 |
| 2010/0090613 | A1 * | 4/2010 | Spartano | 315/287 |

FOREIGN PATENT DOCUMENTS

| | | | |
|---|---|---|---|
| KR | 2003060044 | * | 7/2003 |
| TW | 246525 | * | 10/2004 |

* cited by examiner

MODULAR ILLUMINATION DEVICE

CROSS-REFERENCE TO RELATED APPLICATIONS

This patent application claims the benefit of U.S. Patent Application Ser. No. 61/063,239, filed Feb. 2, 2008, the disclosure of which is incorporated herein by reference.

BACKGROUND OF THE INVENTION

Field of the Invention

This invention relates generally to lighting devices. More specifically, the present invention relates to a modular illumination device.

SUMMARY OF THE INVENTION

The present invention relates generally to lighting devices. More specifically, the present invention relates to a modular illumination device.

In an illustrative, non-limiting embodiment of this invention, the modular illumination device comprises four basic components, which can be combined to form a single lighting device. At least certain of the components are interchangeable such that the configuration of the modular illumination device can be altered or changed to provide a lighting device of the desired configuration.

In certain exemplary, non-limiting embodiments, the basic components of the modular illumination device include an inner body portion, a head assembly, a tail cap portion, and at least one body sleeve. The head assembly is capable of being removably attached or coupled to a first end of the inner body portion, while the tail cap portion is capable of being removably attached or coupled to a second end of the inner body portion. The body sleeve is formed so as to accept the inner body portion within a cavity of the body sleeve. Thus, a variety of body sleeves may be interchangeably utilized.

It should be appreciated that, in certain exemplary embodiments, the head assembly or the tail cap portion may optionally be permanently affixed or constructed as an integral or partially integral portion of the inner body portion. In these exemplary embodiments, only three of the basic components of the modular illumination device are separate and distinct from each other.

In various exemplary embodiments, the tail cap portion comprises a multi-function button assembly. The multifunction button assembly comprises a rotatable, depressible button. In certain exemplary embodiments, the button assembly comprises a single button that is both rotatable and depressible. Alternatively, the button assembly they comprise a rotator that provides the rotatable function of the button assembly and a separate pushbutton that provides the depressible function of the button assembly. While it is possible to use either of these embodiments, for ease of description, the modular illumination device will be described herein as incorporating the single button embodiment. However, it should be understood that this is for illustrative purposes only and should not be construed as limiting the embodiments of the present invention.

By depressing the tail cap button, the user activates distinct functional modes of the lighting device. In an illustrative, non-limiting embodiment of this invention, the various functional modes of the lighting device may be implemented as the output of, for example, a high current MOSFET acting as a microprocessor controller. The various output patterns and on/off functions of the lighting device light source are driven by the controller, which may be pre-programmed at the chip production level.

In an illustrative, non-limiting embodiment of this invention, the controller provides for at least three different light functions. The various functions are defined by the number of times the button is depressed or the length of time that the button is maintained in a depressed state.

By rotating the tail cap button, the intensity of the light source can be adjusted (i.e., dimmed or brightened).

In an illustrative, non-limiting embodiment of this invention, the modular illumination device comprises an electronics assembly, wherein the electronics assembly comprises at least some of a pushbutton rotary encoder, a switching circuit, a battery compartment formed so as to accommodate one or more batteries, a negative battery contact, a positive battery contact, a light source, and a light driver circuit that acts as a controller to control various output patterns and on/off functions of the light source, and wherein the pushbutton rotary encoder, the switching circuit, the negative battery contact, the positive battery contact, the light source, and the light driver circuit are electrically coupled such that appropriate manipulation of the pushbutton rotary encoder can cause the light source to illuminate in a pattern as determined by the light driver circuit; an inner body portion extending from a first end to a second end and defining an interior cavity, wherein the inner body portion is formed so as to accept the electronics assembly within the cavity of the inner body portion; a head assembly removably attached or coupled to the first end of the inner body portion; a tail cap portion removably attached or coupled to the second end of the inner body portion, wherein the tail cap portion comprises a button assembly having a depressible button, wherein the depressible button interacts with the pushbutton rotary encoder; and at least one body sleeve extending from a first end to a second end and defining an interior cavity, wherein the body sleeve is formed so as to accept the inner body portion within the cavity of the body sleeve and to be assembled between the head assembly and the tail cap portion.

In another illustrative, non-limiting embodiment of this invention, the modular illumination device comprises an electronics assembly, wherein the electronics assembly comprises at least some of a pushbutton encoder, a battery compartment formed so as to accommodate one or more batteries, a negative battery contact, a positive battery contact, and a light source, and wherein the pushbutton encoder, the negative battery contact, the positive battery contact, and the light source are electrically coupled such that appropriate manipulation of the pushbutton encoder can cause the light source to illuminate; an inner body portion extending from a first end to a second end and defining an interior cavity, wherein the inner body portion is formed so as to accept the electronics assembly within the cavity of the inner body portion; a head assembly removably attached or coupled to the first end of the inner body portion; a tail cap portion removably attached or coupled to the second end of the inner body portion, wherein the tail cap portion comprises a button assembly having a depressible button, wherein the depressible button interacts with the pushbutton encoder; and at least one body sleeve extending from a first end to a second end and defining an interior cavity, wherein the body sleeve is formed so as to accept the inner body portion within the cavity of the body sleeve and to be assembled between the head assembly and the tail cap portion.

In yet another illustrative, non-limiting embodiment of this invention, the modular illumination device comprises an electronics assembly, wherein the electronics assembly comprises at least some of a pushbutton rotary encoder, a switching circuit, a battery compartment formed so as to accommodate one or more batteries, a negative battery contact, a positive battery contact, a light source, and a light driver circuit that acts as a controller to control various output patterns and on/off functions of the light source, and wherein the pushbutton rotary encoder, the switching circuit, the negative battery contact, the positive battery contact, the light source, and the light driver circuit are electrically coupled such that appropriate manipulation of the pushbutton rotary encoder can cause the light source to illuminate in a pattern as determined by the light driver circuit; an inner body portion extending from a first end to a second end and defining an interior cavity, wherein the inner body portion is formed so as to accept the electronics assembly within the cavity of the inner body portion; a body sleeve extending from a first end to a second end and defining an interior cavity, wherein the body sleeve is formed so as to accept the inner body portion within the cavity of the body sleeve; a head assembly removably attached or coupled to the first end of the body sleeve; and a tail cap portion removably attached or coupled to the second end of the body sleeve, wherein the tail cap portion comprises a button assembly having a depressible button, wherein the depressible button interacts with the pushbutton rotary encoder Accordingly, this invention provides a modular illumination device, which provides for reconfiguration of certain elements of the lighting device.

This invention separately provides a modular illumination device, which optionally provides various light source illumination functions.

This invention separately provides a modular illumination device, which optionally provides for dimming and/or brightening of the light source.

This invention separately provides a modular illumination device, which optionally provides a strobing feature.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF EXEMPLARY EMBODIMENTS

Figure 1:
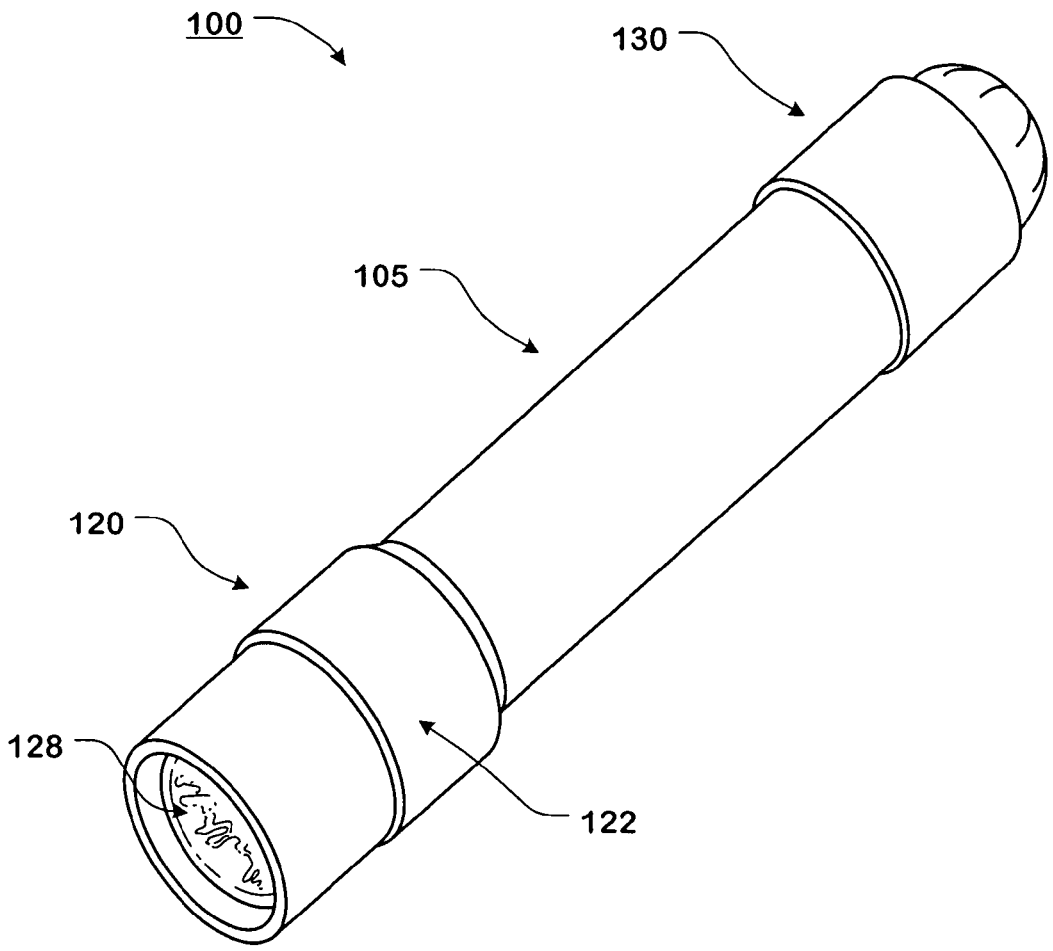
FIG. 1 shows a perspective view of a first exemplary embodiment of a modular illumination device according to this invention.

For simplicity and clarification, the design factors and operating principles of the modular illumination device according to this invention are explained with reference to various exemplary embodiments of a modular illumination device according to this invention. The basic explanation of the design factors and operating principles of the modular illumination device is applicable for the understanding, design, implementation, and operation of the modular illumination device of this invention.

It should also be appreciated that use of the terms "modular illumination device", "body sleeve", "head assembly", "tail cap portion", "button assembly", and "inner body portion" are for a basic explanation and understanding of the operation of the systems, methods, and apparatuses of this invention. Therefore, the terms "modular illumination device", "body sleeve", "head assembly", "tail cap portion", "button assembly", and "inner body portion" are not to be construed as limiting the systems, methods, and/or apparatuses of this invention.

Turning now to the drawing Figs., FIGS. 1-12 show various exemplary embodiments of a modular illumination device according to this invention. As shown in various of the Figs., the modular illumination device 100 comprises at least some of an inner body portion 105 housing an electronics assembly 142, a head assembly 120, a tail cap portion 130, and a body sleeve 110.

In various exemplary embodiments, the head assembly 120 comprises at least some of a bezel 122, a reflector 124, a reflector isolator 124', a glass or other lens 128, and a retaining ring 125.

Figure 12:
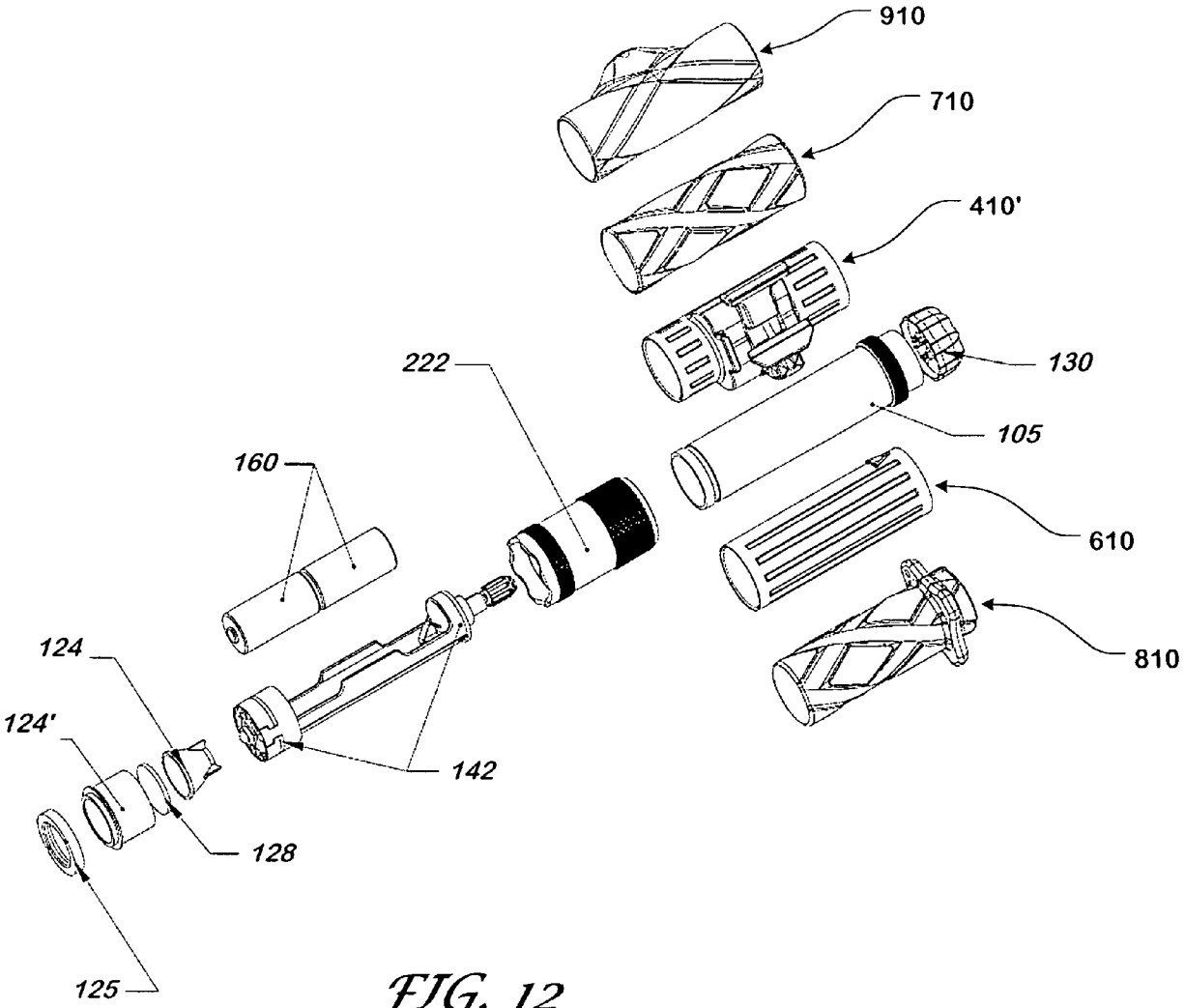
FIG. 12 shows an exploded perspective view of a modular illumination device showing certain optional body sleeves according to this invention.

In various exemplary embodiments, the components of the head assembly 120 are assembled as illustrated in FIG. 12. One or more optional, appropriately sized O-rings (not shown) are included between certain of the components of the head assembly 120. In this manner, a watertight or water resistant seal may be created between the components of the head assembly 120. Additionally, one or more O-rings (not shown) may be used as a shock isolator for the components of the head assembly 120.

The inner body portion 105 comprises a substantially hollow tube and is formed so as to house an electronics assembly 142. It should be appreciated that the inner and/or outer shape of the inner body portion 105 may be generally oval, circular, triangular, square, pentangular, or any other desired shape.

The cavity formed in the inner body portion 105 is shaped such that the electronics assembly 142 may be situated within the cavity formed in the inner body portion 105. In various exemplary embodiments, the components of the electronics assembly 142 are assembled as illustrated in FIGS. 11A-11D.

In various exemplary embodiments, the electronics assembly 142 optionally includes at least some of a pushbutton rotary encoder, a switching circuit, a battery tube or compartment formed so as to accommodate one or more batteries 160, a negative battery contact, a positive battery contact, a light driver circuit, a heat sink, a light source 146, and various programming pads 149 and/or contacts.

In various exemplary embodiments, the battery compartment provides a measure of shock isolation to the batteries 160.

In various exemplary embodiments, the electronics assembly 142 includes one or more recessed channels. Thus, a flexible circuit may be disposed within the one or more recessed channels to electrically couple a switching circuit to the light driver circuit.

The pushbutton rotary encoder is capable of being coupled to the tail cap button and of being depressed and/or rotated. When the pushbutton rotary encoder is depressed or rotated, and input is provided to the switching circuit, which is electrically coupled to the pushbutton rotary encoder so as to receive input regarding depression and/or rotation of the pushbutton reverie encoder.

In various exemplary embodiments, the pushbutton rotary encoder is capable of being rotated continuously clockwise or counterclockwise, without a stop to limit the degree of rotation of the pushbutton rotary encoder. Alternatively, the pushbutton rotary encoder may include one or more stops that limit the degree of rotation of the pushbutton rotary encoder to a predetermined number of degrees. In certain exemplary embodiments, the pushbutton rotary encoder is capable of being smoothly rotated. Alternatively, the pushbutton rotary encoder may include certain detents that provide for incremental rotation of the pushbutton rotary encoder.

The switching circuit is electrically coupled to the light driver circuit and the light driver circuit is electrically coupled to the light source 146.

Although not illustrated in FIGS. 11A-11D, the battery contacts are electrically coupled to one or more of the circuit boards to provide power from an appropriate battery or other voltage or current source to the electronics assembly 142.

While the switching circuit and the light driver circuit may comprise separate and distinct components (as illustrated), the switching circuit, and the light driver circuit may comprise a single component capable of performing both functions. Furthermore, it should be appreciated that the functions of the switching circuit and/or the light driver circuit may be performed by either the switching circuit or the light driver circuit. Since the light driver circuit and the switching circuit work to provide a controller for the light source 146 the combination of the switching circuit and the light driver circuit is sometimes referred to herein as the controller.

In various exemplary embodiments, the controller (as embodied in the switching circuit, the light driver circuit, or a combination of both circuits) comprises an integrated circuit that functions as a solid-state control for the modular illumination device 100. In this manner, the various output patterns and on/off functions of the light source 146 may be driven and/or controlled by the controller. In various exemplary, non-limiting embodiments, the controller comprises one or more high current MOSFETs that function as a microprocessor-controlled button. The controller may be pre-programmed at the chip production level.

In various exemplary embodiments, the controller may be programmed and/or reprogrammed based on the specific functions and/or modes desired by the user. Thus, the specific functions, channels, and/or modes of the modular illumination device 100 may be established and/or altered by a user.

In various exemplary embodiments, the controller may be programmed and/or reprogrammed via a direct or indirect linked connection to a programming and/or reprogramming device. For example, one or more plugs, contact points, programming pads, and/or contacts may be electrically coupled to the controller, such that the controller may be coupled, via one or more corresponding plugs, contact points, programming pads, and/or contacts, to a programming and/or reprogramming device.

However, it should be appreciated that the linked connection can be any known or later developed device or system for connecting the controller to a programming and/or reprogramming device, including a direct wired connection, a connection over a cellular telephone network, a very high frequency (VHF) connection, an ultra high frequency (UHF) connection, a radio frequency (RF) connection, a satellite connection, or the like. In general, the linked connection can be any known or later developed connection system or structure usable to connect a programming and/or reprogramming device to the controller, including both wired and wireless connections.

The controller may, for example, be programmed to initially illuminate the light source 146 at a particular light level. The controller may also be programmed to initially illuminate the light source 146 in an on/off, or strobe, mode. In various exemplary embodiments, the controller may strobe the light source 146 at a rate of greater than 0 to 60 Hz. In other exemplary embodiments, the controller may strobe the light source 146 at a rate of greater than 0 to 30 Hz. In still other exemplary embodiments, the controller may strobe the light source 146 at a rate of about 8 to 20 Hz.

The particular strobe rate may be predetermined and fixed or may be adjustable. In various exemplary embodiments, a particular strobe rate may be chosen based on a desired effect of the strobed light on an individual. For example, a strobing rate may be chosen, which effectively masks tactical movement but is not in a realm that can trigger adverse effects in an individual.

The controller may be programmed to illuminate the light source 146 in a signaling mode. In the signaling mode, the controller controls the light source 146 to emit either visible or non-visible light in a predetermined on/off pattern. In various exemplary embodiments, the signaling pattern may be a standard, preprogrammed pattern, such as, for example, a Morse code pattern. Alternatively, the signaling pattern may be a specific, user-defined pattern.

Visible light and/or non-visible light may be used to provide a signaling pattern. For example, a visible light signaling pattern may be used in a non-covert emergency situation to facilitate the location and/or identification of an individual. Alternatively, a non-visible light signaling pattern may be used to facilitate the location and/or identification of an individual in need of rescue in a covert situation.

It should be appreciated that light signaling patterns may comprise visible light patterns, non-visible light patterns, or a combination of visible and non-visible light patterns.

In various exemplary embodiments, the light source 146 comprises a LED. Alternatively, the light source 146 may comprise an incandescent, infrared, laser, or other known or later developed visible or non-visible wavelength illumination device. In various other exemplary embodiments, the light source 146 may comprise a combination of one or more LEDs, incandescent, infrared, laser, or other known or later developed visible or non-visible wavelength illumination devices.

Although not illustrated in FIGS. 11A-11D, additional materials, such as, for example, gaskets or additional O-rings (not shown), may be included between various components of the electronics assembly 142 to provide a level of shock isolation to the components of the electronics assembly 142.

The inner body portion 105 comprises and elongate portion having a first end and a second end. In various exemplary embodiments, each end of the inner body portion 105 includes an external (as illustrated) or internal threaded portion. The threaded portion or portions of the inner body portion 105 are formed so as to correspond to mating internal or external threads of the head assembly 120 and the tail cap portion 130. The inner body portion 105 comprises an inner cavity that is capable of accepting the electronics assembly 142, while the exterior of the inner body portion 105 is formed so as to fit within a body sleeve 110.

While not illustrated, the inner body portion 105 and the body sleeve 110 may include cooperating alignment means. The alignment means operate such that, when the body sleeve 110 is fitted over the inner body portion 105, the inner body portion 105 is properly indexed to the body sleeve 110. In various exemplary embodiments, the alignment means may comprise an anti-rotation pin extending from the interior of the body sleeve 110 and positioned so as to engage a corresponding alignment groove formed in the exterior of the inner body portion 105. Alternatively, the alignment means may comprise an alignment groove formed in the interior of the body sleeve 110 and positioned so as to engage a corresponding anti-rotation pin extending from the exterior of the inner body portion 105.

In various exemplary embodiments, the alignment means comprise a notch formed in either the inner body portion 105 or the body sleeve 110 and positioned so as to engage a corresponding mating block formed in either the body sleeve 110 or the inner body portion 105, respectively.

It should be appreciated that the inner body portion 105 may have an exterior shape or one or more surface preparations, grooves, or the like, which correspond to an interior shape or other interior surface preparations, grooves, or the like of the interior of the body sleeve 110 such that, once engaged, the body sleeve 110 does not rotate with respect to the inner body portion 105.

The exterior of the body sleeve 110 may be formed so as to include various surface preparations, textured portions, protrusions, intentions, grooves, flats, mounting assemblies, clips, rails, grips, anti-rotation features, and the like. In various exemplary embodiments, at least a portion of the outer diameter of the body sleeve 110 is such that the modular illumination device 100 may be mounted on a variety of devices using known ring mounts. At least a portion of the body sleeve 110 may include a groove or flat portion that provides an anti-rotation feature to the modular illumination device 100 when held within a ring mount.

By way of illustration and not exclusion, several exemplary body sleeve and modular illumination device combinations are discussed and illustrated. Thus, it should be appreciated that the exterior of the body sleeve may take any desired form or shape based upon the ornamental appearance, functionality, compatibility, and/or interactivity of the body sleeve, and ultimately the modular illumination device.

Figure 3A:
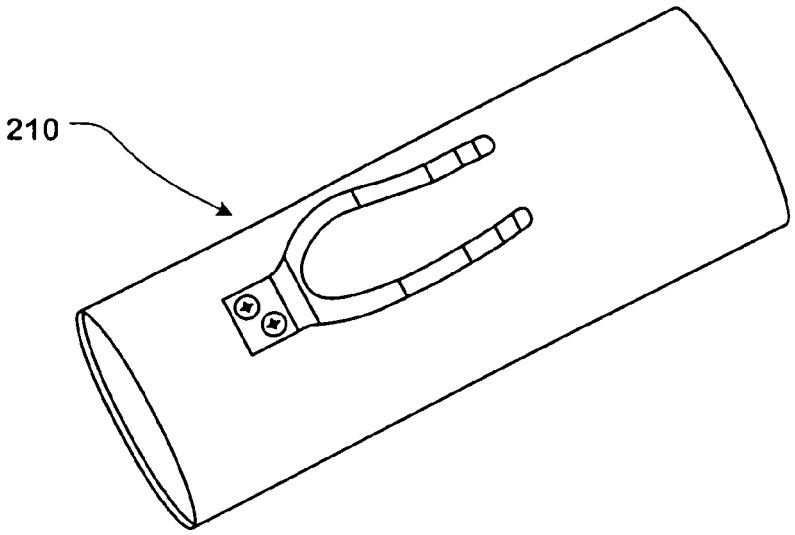
FIG. 3A shows an exemplary body sleeve having an exemplary clip according to this invention.
Figure 3B:
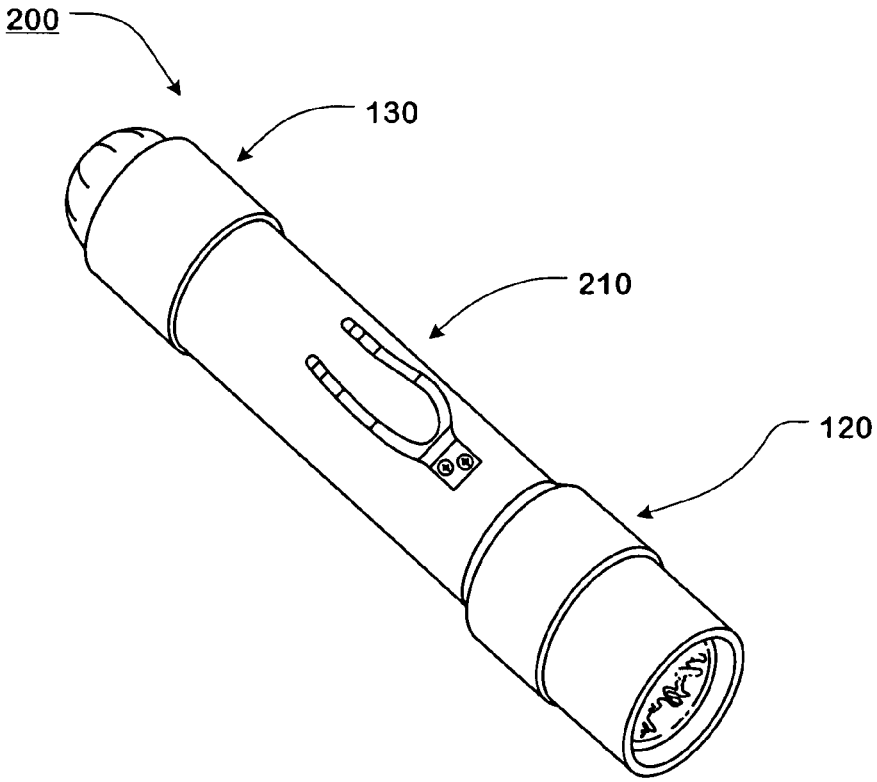
FIG. 3B shows an exemplary embodiment of a modular illumination device utilizing a body sleeve having an exemplary clip according to this invention.

FIG. 3A shows an exemplary body sleeve 210 having an exemplary clip according to this invention. FIG. 3B shows an exemplary embodiment of a modular illumination device 200 utilizing the body sleeve 210 having the exemplary clip. It should be understood that while the body sleeve 210 is shown having a relatively smooth exterior surface, the body sleeve 210 may incorporate any exterior shape and/or any desired surface preparations.

Likewise, while the clip is illustrated as having a generally wishbone shape, a clip having any size shape or configuration may be utilized with the body sleeve 210.

Furthermore, while the clip is illustrated as being coupled, via screws, to the body sleeve 210, it should be appreciated that the clip may be otherwise affixed, attached, or coupled to the body sleeve 210 were may be formed as an integral part of the body sleeve 210.

Figure 4A:
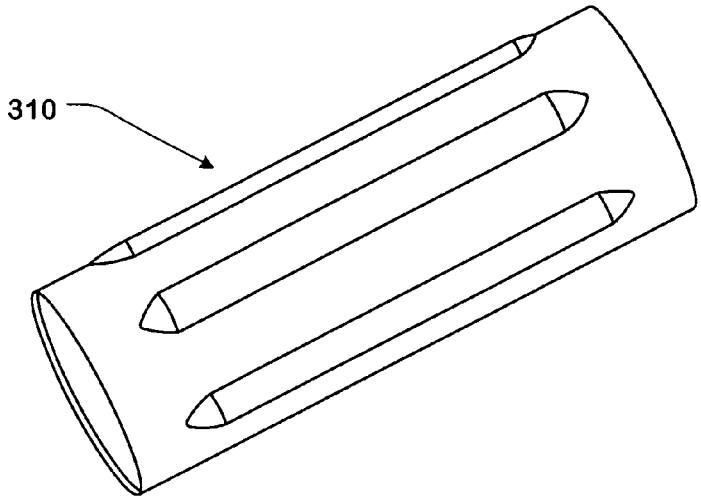
FIG. 4A shows an exemplary body sleeve having exemplary longitudinal surface preparations according to this invention.
Figure 4B:
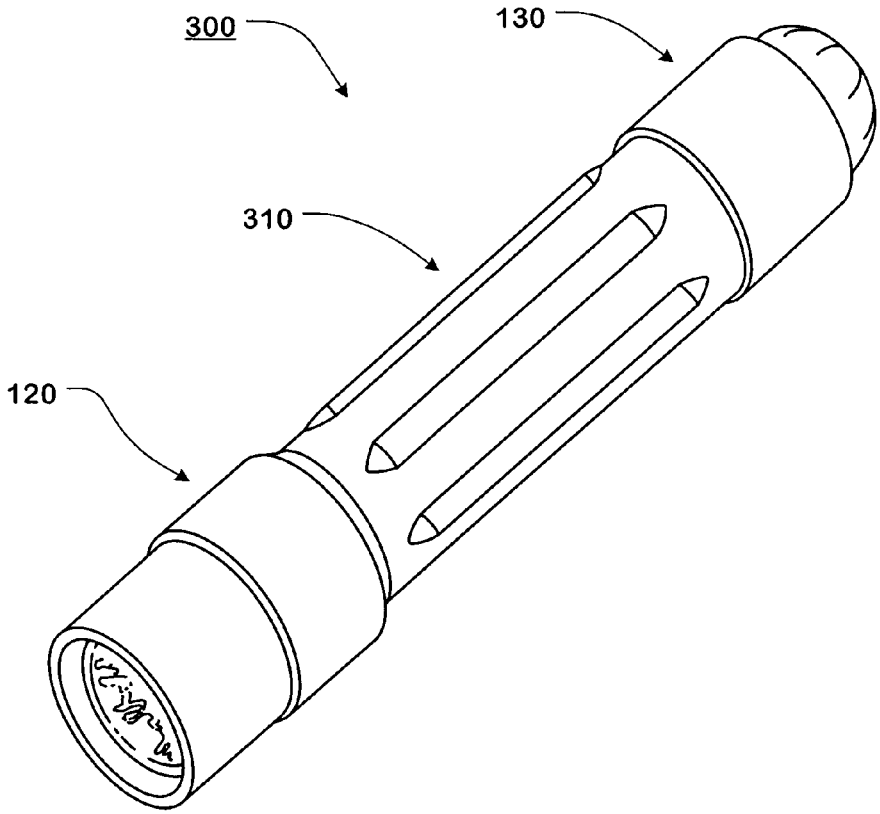
FIG. 4B shows an exemplary embodiment of a modular illumination device utilizing a body sleeve having exemplary longitudinal surface preparations according to this invention.

FIG. 4A shows an exemplary body sleeve 310 having exemplary longitudinal surface preparations according to this invention, while FIG. 4B shows an exemplary embodiment of a modular illumination device 300 utilizing the body sleeve 310.

Figure 5A:
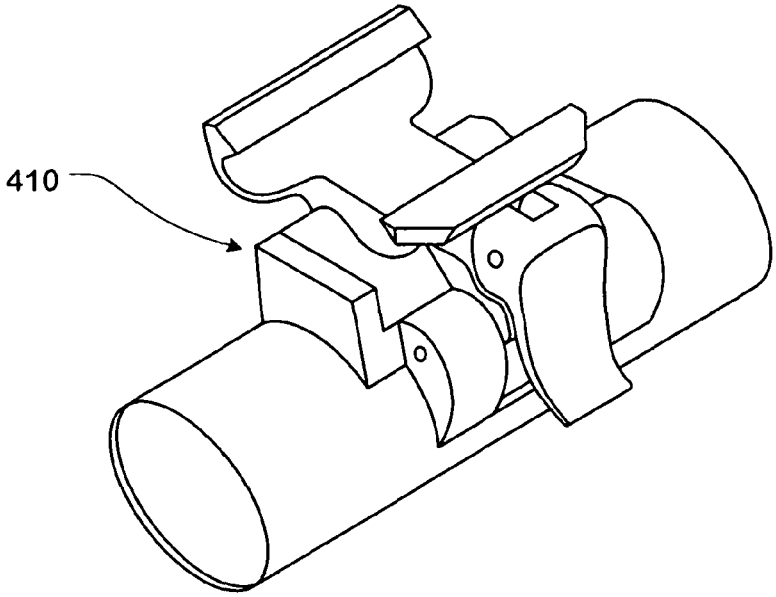
FIG. 5A shows a perspective view of an exemplary body sleeve incorporating an exemplary rail mounting device according to this invention.

FIG. 5A shows a perspective view of an exemplary body sleeve 410 incorporating an exemplary rail mounting device according to this invention.

In various exemplary, non-limiting embodiments, the rail mounting device comprises the offset accessory mount and/or accessory mounting clamp as shown and described in co-pending U.S. patent application Ser. No. 11/985,659, Filed Nov. 16, 2007, entitled Offset Accessory Mount, the entire disclosure of which is incorporated herein by reference.

Figure 5B:
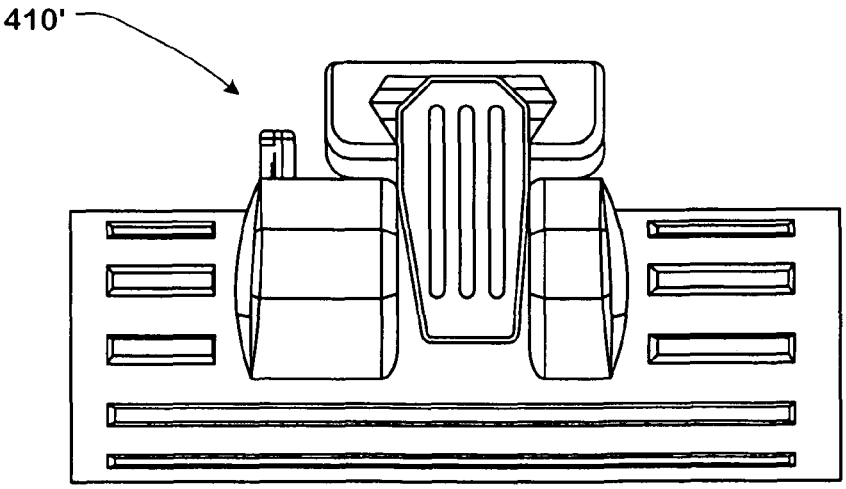
FIG. 5B shows a side view of a modified exemplary body sleeve incorporating an exemplary rail mounting device according to this invention.
Figure 5C:
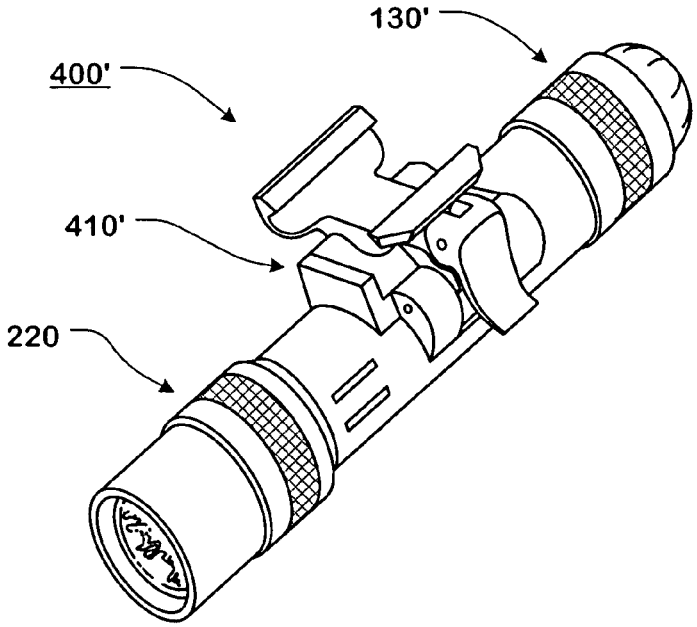
FIG. 5C shows an exemplary embodiment of a modular illumination device utilizing a body sleeve incorporating an exemplary rail mounting device, the first exemplary embodiment of the tail cap portion, and the second exemplary embodiment of the head assembly according to this invention.
Figure 5D:
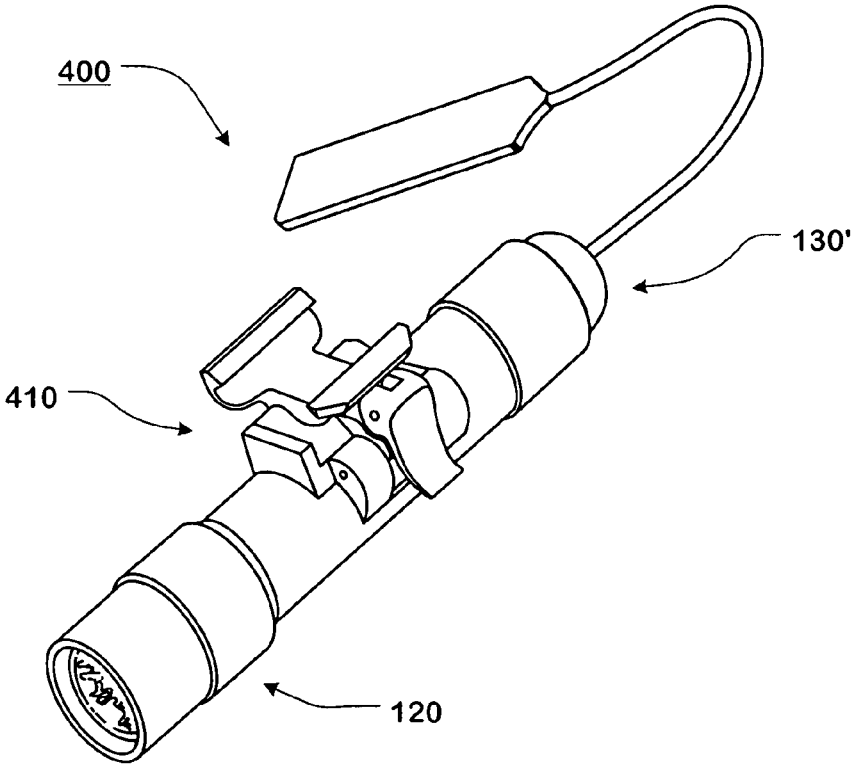
FIG. 5D shows an exemplary embodiment of a modular illumination device utilizing a body sleeve incorporating an exemplary rail mounting device and the second exemplary embodiment of the tail cap portion according to this invention.

As illustrated in FIGS. 5A and 5D, the body sleeve 410 may comprise a is relatively smooth exterior surface. Alternatively, as illustrated in FIGS. 5B and 5C, the body sleeve 410' may incorporate certain surface preparations, such as, for example, recesses, or grooves.

To further illustrate the interchangeability of components, as illustrated in FIG. 5C, the body sleeve 410' (wherein the body sleeve 410' includes a series of recesses or grooves) is used in conjunction with a tail cap portion 130' (wherein the tail cap portion 130' includes knurled portions around the outer circumference and a shortened collar portion) and a head assembly 220 (wherein the head assembly 220 includes knurled portions around the outer circumference and a scalloped front edge).

As illustrated in FIG. 5D, the body sleeve 410 (wherein the body sleeve 410 is relatively smooth) is used in conjunction with a tail cap portion 130 (wherein the tail cap portion 130 includes a relatively smooth outer surface and an extended collar portion) and a head assembly 120 (wherein the head assembly 120 includes a relatively smooth outer surface and a front portion having a reduced diameter as compared to a rear portion, resulting in a shoulder between the front portion and the rear portion).

Figure 6A:
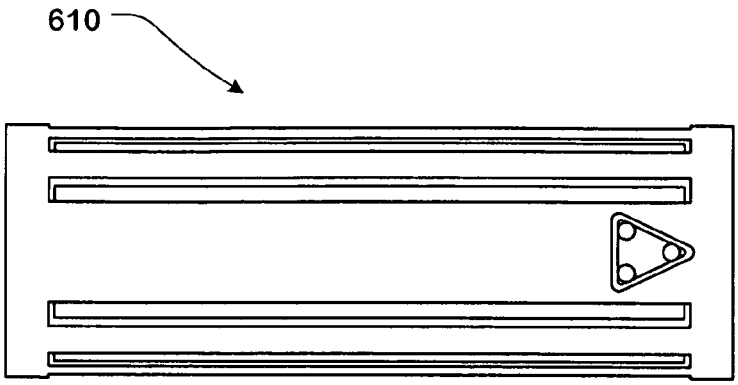
FIG. 6A shows an exemplary body sleeve capable of accepting an exemplary clip and having recessed longitudinal surface preparations according to this invention.
Figure 6B:
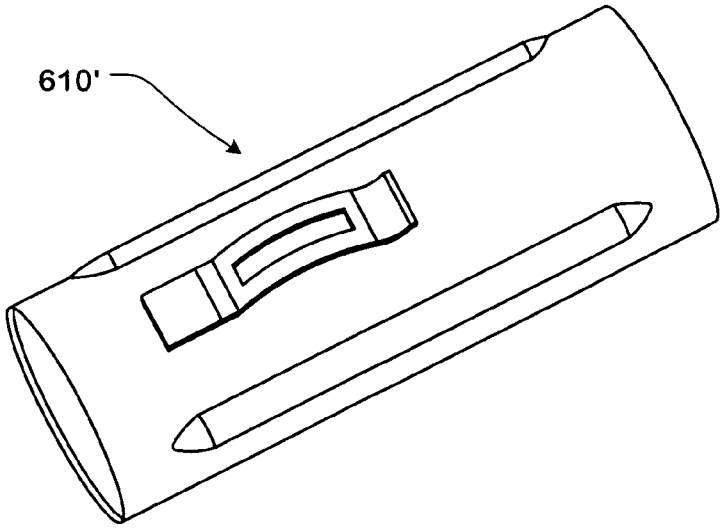
FIG. 6B shows an exemplary body sleeve having an exemplary clip and protruding longitudinal surface preparations according to this invention.

FIG. 6A shows an exemplary body sleeve for if for capable of accepting an exemplary clip and having recessed longitudinal surface preparations. FIG. 6B shows an exemplary body sleeve 610' having an exemplary clip and protruding longitudinal surface preparations.

Figure 7A:
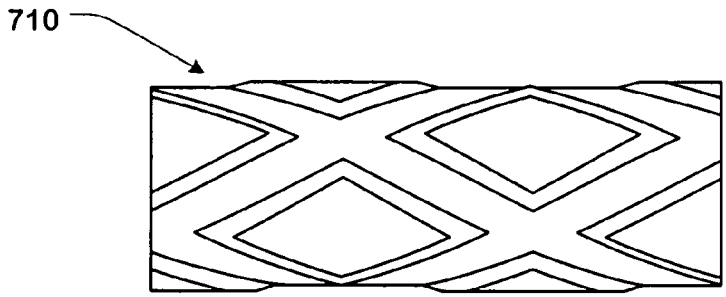
FIG. 7A shows an exemplary body sleeve having substantially diamond shaped surface preparations according to this invention.
Figure 7B:
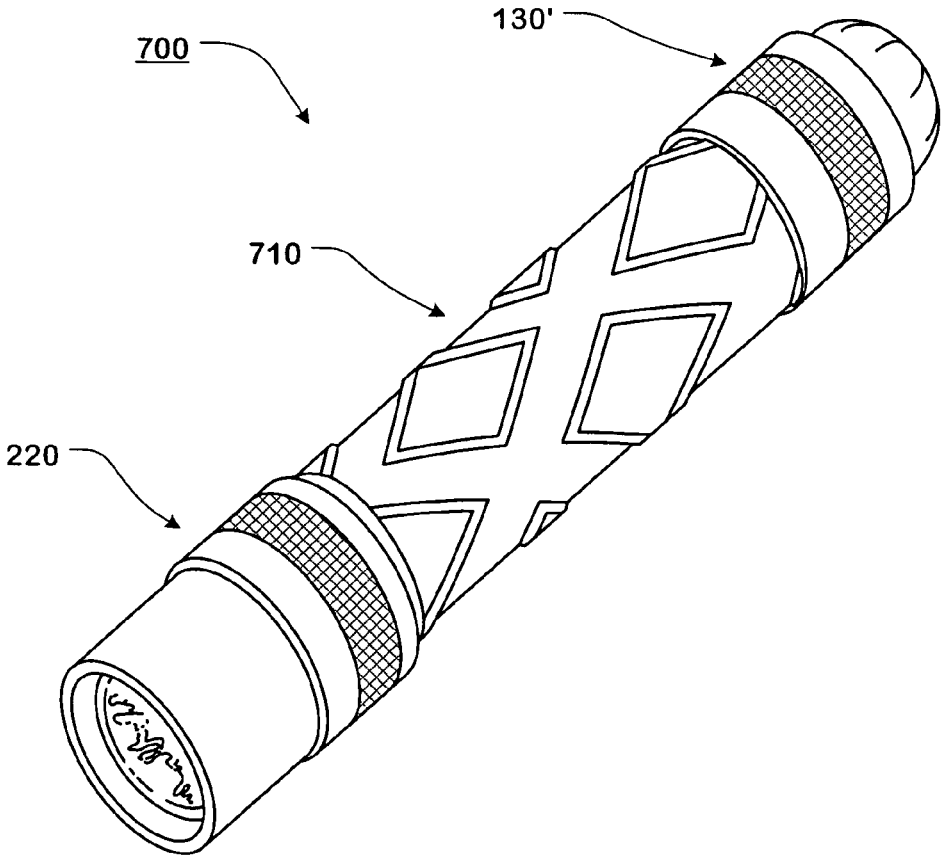
FIG. 7B shows an exemplary embodiment of a modular illumination device utilizing a body sleeve having substantially diamond shaped surface preparations and a second exemplary embodiment of a head assembly according to this invention.

FIG. 7A shows an exemplary body sleeve 710 having substantially diamond shaped surface preparations, while FIG. 7B shows an exemplary embodiment of a modular illumination device 700 utilizing the body sleeve 710 having substantially diamond shaped surface preparations, a head assembly 220, and a tail cap portion 130'.

Figure 8A:
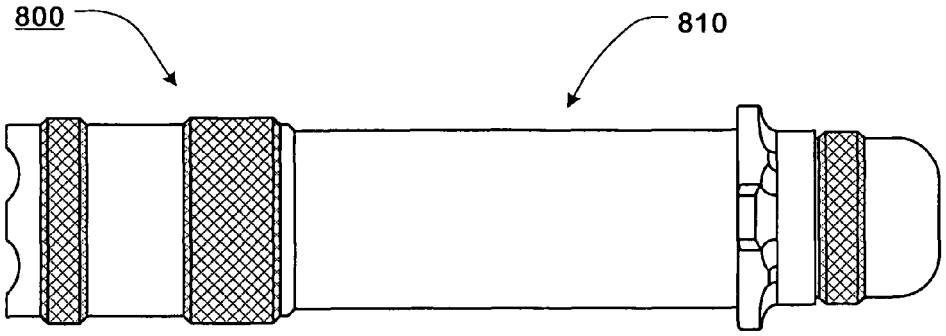
FIG. 8A shows a plan view of an exemplary embodiment of a modular illumination device utilizing a body sleeve having an exemplary syringe style grip, the first exemplary embodiment of the tail cap portion, and the second exemplary embodiment of the head assembly according to this invention.
Figure 8B:
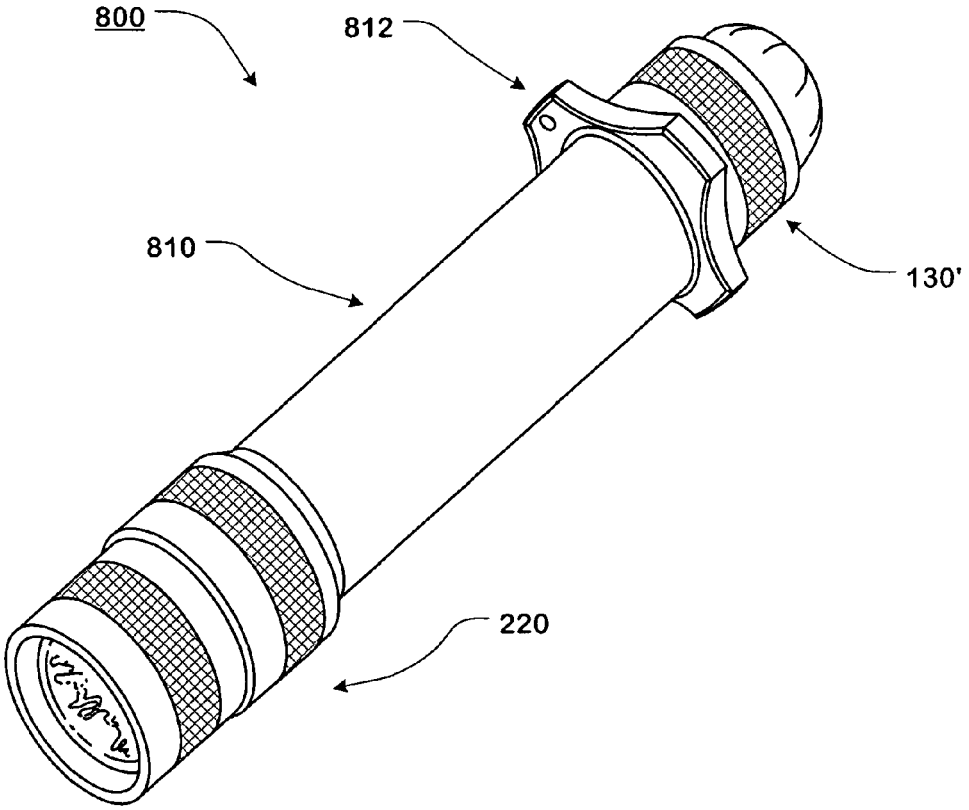
FIG. 8B shows a perspective view of an exemplary embodiment of a modular illumination device utilizing a body sleeve having an exemplary syringe style grip, the first exemplary embodiment of the tail cap portion, and the second exemplary embodiment of the head assembly according to this invention.

FIGS. 8A and 8B show a plan view and a perspective view, respectively, of an exemplary embodiment of a modular illumination device 800 utilizing a body sleeve 810 having an exemplary syringe style grip, the tail cap portion 130', and the head assembly 220 according to this invention.

As illustrated in FIGS. 8A and 8B, the body sleeve 810 includes a plurality of lugs 812 that extend substantially radially from the body sleeve 810. The lugs provide an anti-roll featured to the modular illumination device 100. The lugs 812 may be contoured so as to assist in certain specialized grip techniques when employed with a firearm or be used as a defensive tool or a tool in personal control techniques. Additionally, the lugs 812 may include one or more holes or other attachment means such that a lanyard or other device may be attached to the body sleeve 810. It should be understood that while the body sleeve 810 is shown as having four lugs 812, the number and shape of the lugs is a design choice based on the desired functionality of the lugs.

Figure 9A:
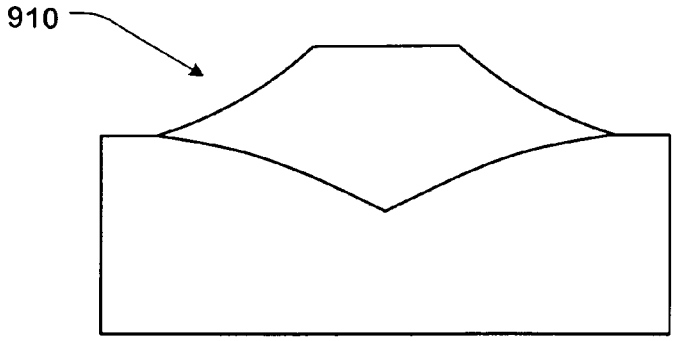
FIG. 9A shows an exemplary body sleeve having a body mounting and/or attachment portion according to this invention.
Figure 9B:
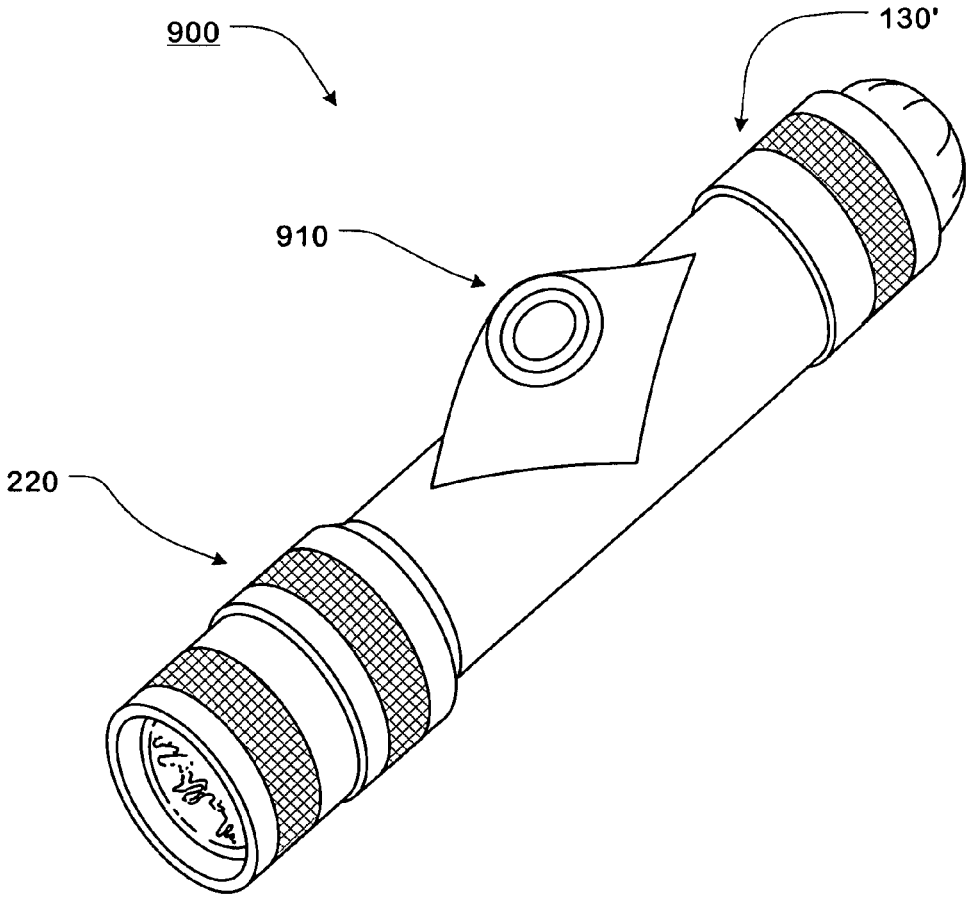
FIG. 9B shows an exemplary embodiment of a modular illumination device utilizing a body sleeve having a body mounting and/or attachment portion and a second exemplary embodiment of a head assembly according to this invention.

FIG. 9A shows an exemplary body sleeve 910 having a body mounting and/or attachment portion, while FIG. 9B shows an exemplary embodiment of a modular illumination device 900 utilizing the body sleeve 910.

FIGS. 15-19 show the exemplary body sleeve of FIGS. 9A and 9B utilized in connection with a body mounting and/or attachment portion according to this invention. As illustrated, certain retractable locking devices protrude into the body mounting and/or attachment portion of the body sleeve 910 to maintain it in position.

Figure 10A:
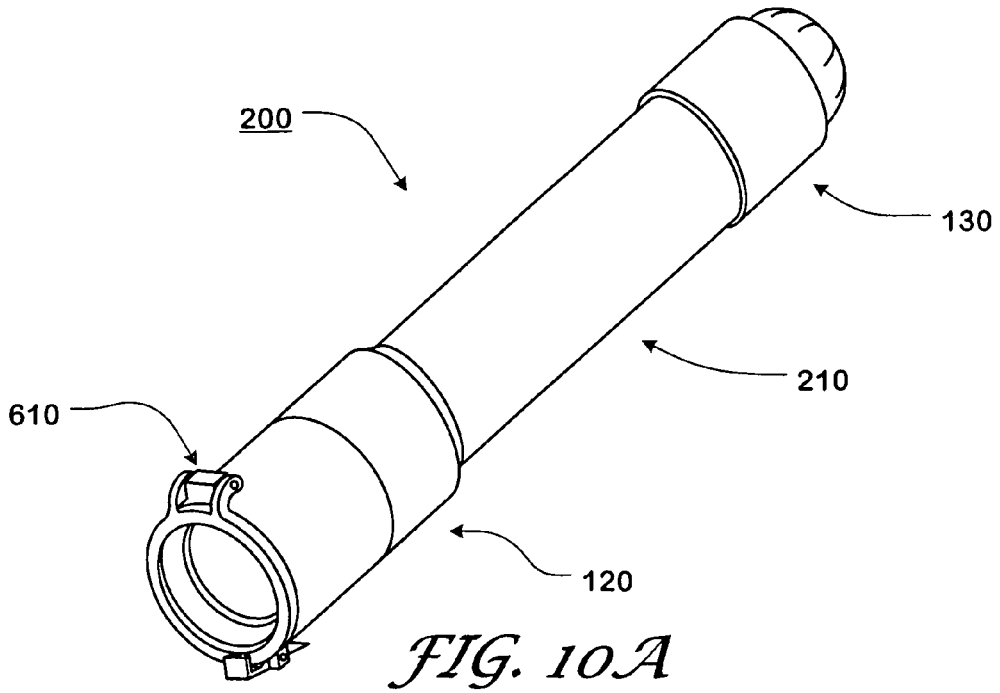
FIG. 10A shows a first exemplary embodiment of a modular illumination device utilizing an attached or coupled filter according to this invention.
Figure 10B:
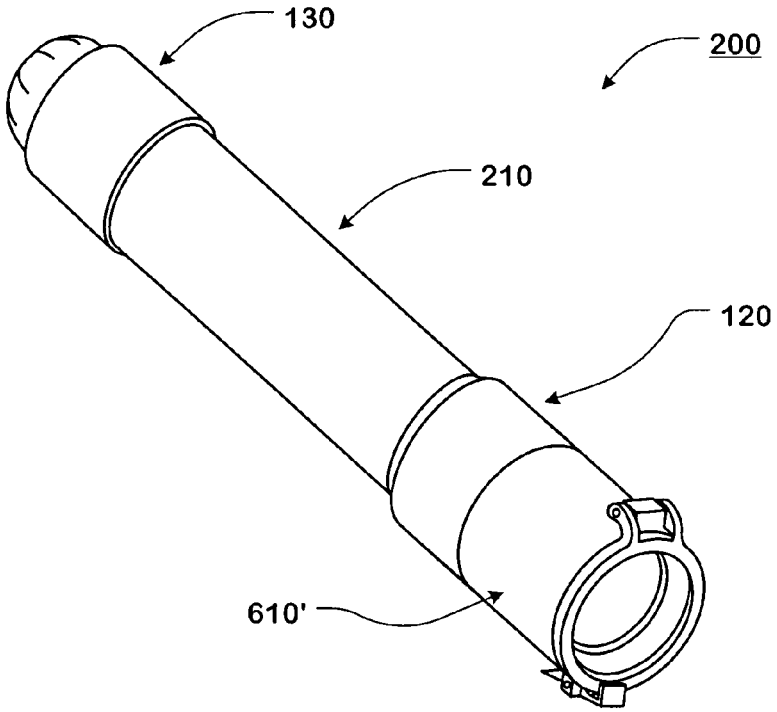
FIG. 10B shows a second exemplary embodiment of a modular illumination device utilizing an attached or coupled filter according to this invention.
Figure 11A:
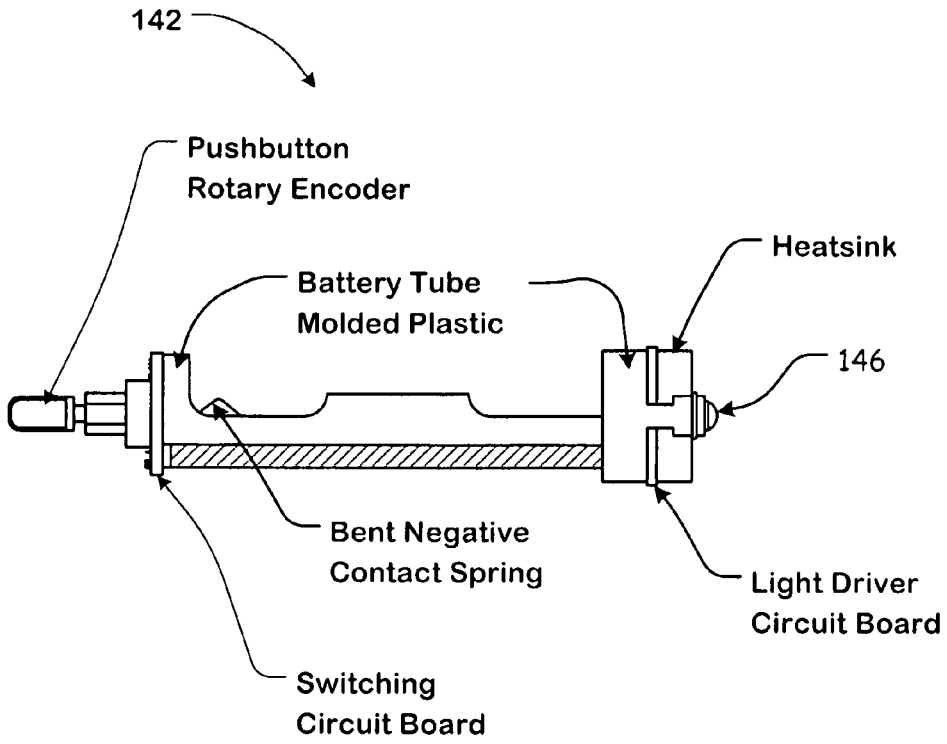
FIG. 11A shows a side view of an inner body portion according to this invention.
Figure 11B:
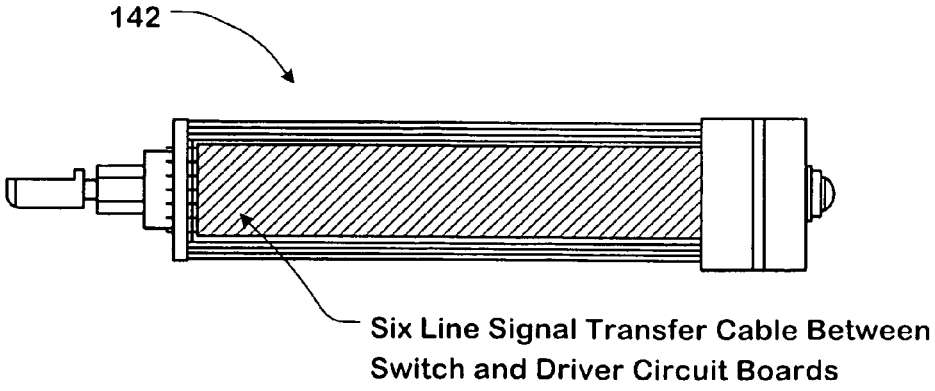
FIG. 11B shows a bottom view of an inner body portion according to this invention.
Figure 11C:
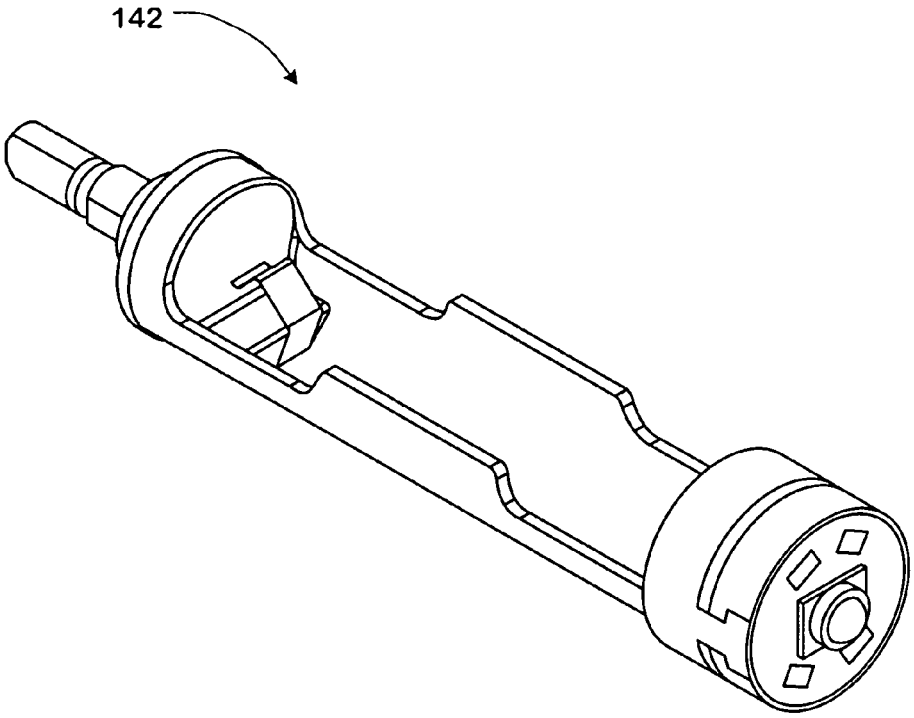
FIG. 11C shows a front perspective view of an inner body portion according to this invention.
Figure 11D:
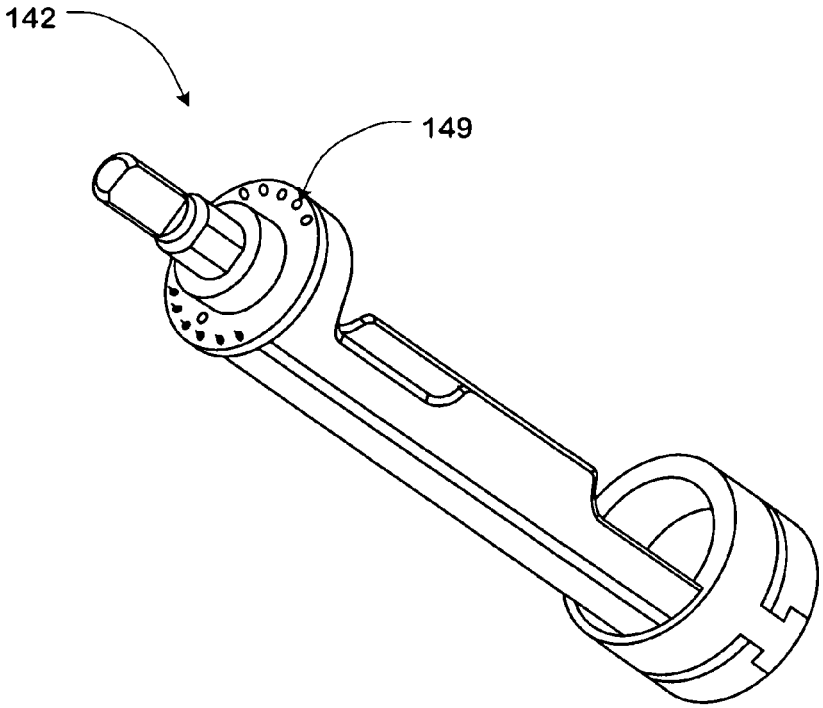
FIG. 11D shows a rear perspective view of an inner body portion according to this invention.

As illustrated in FIGS. 10A and 10B, the head assembly 120, and more specifically, the bezel 122 can be shaped so as to accept a filter assembly 1010 or 1010'. In various exemplary embodiments, the filter assembly 1010 or 1010' is sized so as to be fractionally maintained in position on the head assembly 120. Alternatively, the filter assembly may be threadedly or otherwise coupled are attached to the head assembly 120. While the filter assemblies 1010 and 1010' are illustrated as having lenses or filters that are hingedly coupled to the filter assemblies 1010 and 1010', it should be appreciated that the lenses or filters may be permanently attached to the filter assemblies 1010 and 1010'.

In various exemplary embodiments, at least a portion of the bezel 122 has a 1¼ inch outer diameter. Thus, a wide variety of known external light filtering and/or shuttering devices may be coupled to the bezel 122. The bezel 122 may include a scalloped surface or end portion.

The tail cap portion 130, or tail cap, comprises at least some of a collar 132 and a button 136. In various exemplary embodiments, the collar 132 is internally or externally threaded such that the tail cap portion 130 may be threadedly attached to corresponding internal or external threads at an end of the inner body portion 105.

When the tail cap portion 130 is attached to the inner body portion 105, the tail cap button 136 interacts with the pushbutton rotary encoder of the electronics assembly 142. Thus, when the tail cap button 136 is depressed the pushbutton rotary encoder is depressed. When the tail cap button 136 is rotated, the pushbutton rotary encoder is rotated.

Figure 2A:
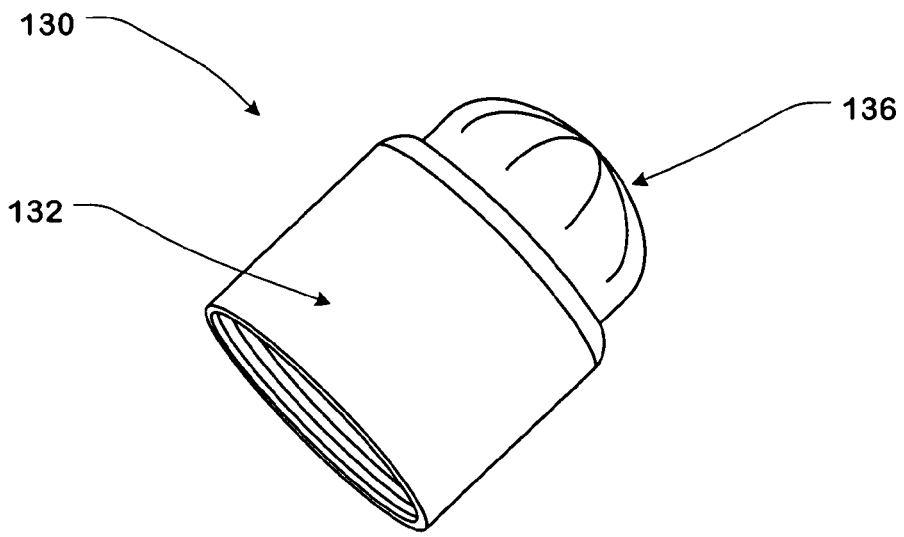
FIG. 2A shows a first exemplary embodiment of a tail cap portion according to this invention.
Figure 2B:
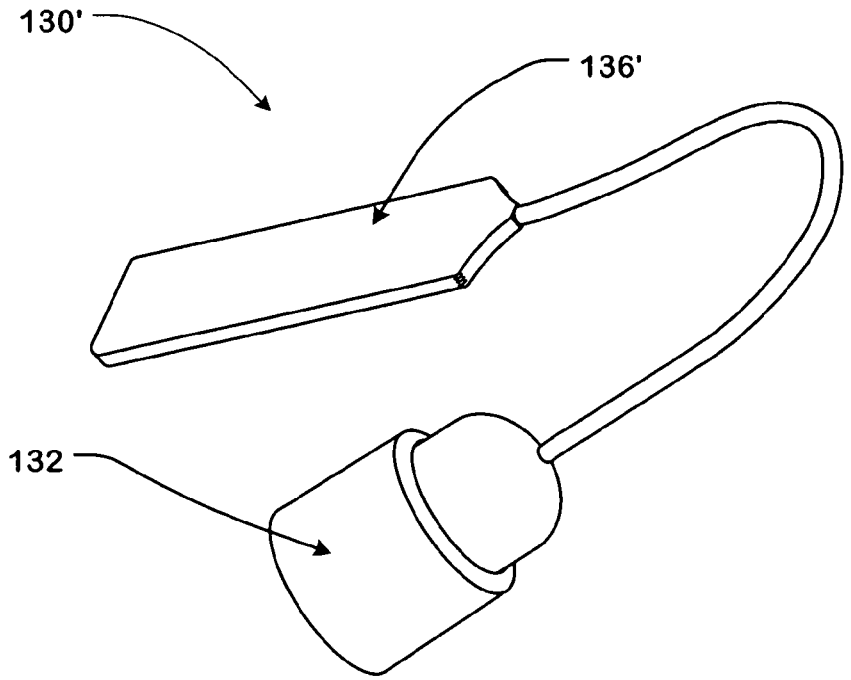
FIG. 2B shows a second exemplary embodiment of a tail cap portion according to this invention.

FIG. 2B shows a second exemplary embodiment of a tail cap portion 130', according to this invention. As illustrated in FIG. 2B the button 136 (as illustrated in FIG. 2A) is replaced by an optional tape switch, which extends from the collar 132 of the tail cap portion 130'. As illustrated in FIG. 2B, the tape switch includes a pressure-activated switch, or pressure pad 136' that can be depressed to activate the features of the modular illumination device 100, as described herein. The pressure pad 136' includes a tape switch coupler that makes appropriate contact with the controller such that depression of the pressure pad 136' can act to activate the controller.

It should be appreciated that any known or later developed pressure pad may be used as the pressure pad 136'. Thus, the size, shape, and orientation of the pressure pad 136' is a design choice based upon the desired functionality of the tape switch.

While not illustrated, one or more of the inner body portion 105, the head assembly 120, and/or the tail cap portion 130 may include cooperating alignment means. The alignment means operate such that, when the head assembly 120 or the tail cap portion 130 is coupled to the inner body portion 105, the head assembly 120 or the tail cap portion 130 is properly indexed to the inner body portion 105. In various exemplary embodiments, the alignment means comprise an anti-rotation pin extending from the interior of the inner body portion 105 and positioned so as to engage a corresponding alignment groove formed in the interior of the inner body portion 105 or the head assembly 120, respectively. Alternatively, the alignment means may comprise an alignment groove formed in the exterior of the inner body portion 105 and positioned so as to engage a corresponding anti-rotation pin extending from the interior of the inner body portion 105 or the head assembly 120, respectively.

In various exemplary embodiments, the alignment means comprise a notch formed in either the inner body portion 105, the head assembly 120, or the tail cap portion 130 and positioned so as to engage a corresponding mating block formed in either the inner body portion 105, the head assembly 120, or the tail cap portion 130, respectively.

It should be appreciated that an inner threaded portion of the head assembly 120 or the tail cap portion 130 corresponds to an outer threaded portion of the inner body portion 105. Alternatively, an inner threaded portion of the inner body portion 105 corresponds to an outer threaded portion of the head assembly 120 or the tail cap portion 130.

Thus, the tail cap portion 130 or the head assembly 120 may be removably attached to the inner body portion 105. In various exemplary embodiments, an O-ring (not shown) may be included in an appropriately sized groove in the outer surface of the inner body portion 105 to provide a water resistant or shock absorbent seal between the inner body portion 105 and the head assembly 120 or the tail cap portion 130.

In various exemplary, non-limiting embodiments, at least some of the inner body portion 105, the head assembly 120, or the tail cap portion 130 may be formed of aluminum, a plastic, such as, for example, a thermoplastic or a polypropylene plastic, or stainless steel.

However, it should be understood that this listing of exemplary materials is not to be construed as limiting the materials that are used to form the various components of the modular illumination device 100. Alternate materials of construction may include one or more of the following: steel, aluminum, titanium, and/or other ferros or non-ferros metals, as well as various alloys and composites thereof, glass-hardened polymers, polymer or fiber reinforced metals, carbon fiber or glass fiber composites, thermoset or thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, polymers, polymeric composites, thermoplastics, polypropylene, nylon, glass, or polymer fiber reinforced plastics, thermoform and/or thermoset sheet materials, and/or various combinations of the foregoing. Thus, it should be understood that the material or materials used to form the various components of the modular illumination device 100 is a design choice based on the desired appearance and functionality of the various components of the modular illumination device 100.

One or more optional, appropriately sized O-rings (not shown) may be included between the head assembly 120 and the inner body portion 105 and/or between a tail cap assembly 130 and the inner body portion 105.

While the head assembly 120 is generally removably attached are coupled to the inner body portion 105, in various exemplary embodiments, the head assembly 120 may be permanently attached or coupled to the inner body portion 105. Alternatively, the head assembly 120 may be formed as an integral part of the inner body portion 105.

Similarly, while the tail cap assembly 130 is generally removably attached are coupled to the inner body portion 105, in various exemplary embodiments, the tail cap assembly 130 may be permanently attached or coupled to the inner body portion 105. Alternatively, the tail cap assembly 130 may be formed as an integral part of the inner body portion 105.

During use of the modular illumination device 100, when the button 136 is depressed, an actuator is moved from a spring biased, or first position within the tail cap assembly 130 to a depressed, or second, position within the tail cap assembly 130. When the actuator is moved from the first position to the second position, a signal is sent to the controller.

When the controller receives a signal that the button 136 has been activated, the controller determines the output function for the light source 146 that is represented by the number of times and/or duration of time that the button 136 is depressed and activates the light source 146 appropriately.

When the button 136 is rotated the controller will control the light source 146 to brighten or dim (using, for example, pulse width modulation) based on the rotation of the button 136. For example, if the button 136 is rotated clockwise, the light source 146 may be controlled to brighten and if the button 136 is rotated counterclockwise, the light source 146 may be controlled to dim. Alternatively, it may be established that when the button 136 is rotated clockwise, the light source 146 may be controlled to dim and if the button 136 is rotated counterclockwise, the light source 146 may be controlled to brighten.

Thus, each light activating function is defined by the number of times and/or duration of time that the button 136 is depressed, while the intensity of the light source 146 is controlled by the axial position of the button 136.

In an illustrative, non-limiting embodiment of this invention, the controller is capable of controlling the light source 146 to produce three different light emitting functions. In one exemplary embodiment, the three light emitting functions include a constant on mode, a momentary on mode, and a strobe mode.

In a strobe mode, the light source 146 may be controlled to illuminate at maximum power then off at a rate of about 8-20 Hz. In various exemplary embodiments, if the button 136 is rotated in the strobe mode, the rate of strobe can be altered.

In the constant on or momentary on mode, the light source 146 can be illuminated at maximum power or adjusted to a lower power setting, allowing use of the light at less than full brightness or at the last saved level.

In various exemplary embodiments, manual programming of the light can be achieved by depressing the button 136 for a determined period of time, such as, for example, 10 seconds. After the determined very time has been achieved, the light source 146 blinks twice. After the light source blanks twice, the button 136 must be depressed for another determined period time, such as, for example, 10 seconds. Once the second predetermined period time has run, the light source 146 in blinks twice and advances to the next preprogrammed mode. In this manner, the light is capable of cycling through predetermined levels such as full brightness, full dimm, and last saved level.

Hold past half applicable at once light goes on three times a strobe hold it past half a second to momentary on but as soon as you let go a turnoff If the button 136 is maintained in a depressed state for a brief period of time, such as, for example, approximately 1 to 3 seconds, the light may be controlled to dim. Over, for example, approximately 5 seconds, the light will dim from maximum brightness to minimum brightness. If the button 136 is released at any point during the dimming cycle, the light output from the light source 146 will remain at the brightness/power output level the light source 146 was at when the button 136 was released.

If the button 136 is once again maintained in a depressed state for a brief period of time, the light begins to brighten from the brightness level the light source 146 was at when the button 136 was initially released. Over a period of time, the light will brighten to maximum brightness. If the button 136 is released at any point during the brightening cycle, the light output from the light source 146 will remain at the brightness/power output level the light source 146 was at when the button 136 was released.

Thus, so long as the button 136 is maintained in a depressed state for a brief period of time and them released, the brightness level of the light source 146 will continue to cycle from a maximum brightness to a minimum brightness, or vice versa. When the button 136 is depressed and released relatively quickly, the light source 146 is turned off.

In various exemplary embodiments, the button 136 may also be used to activate a lockout mode. The purpose of the lockout mode is to prevent the light from being illuminated or extinguished unintentionally. Activating the lockout mode is achieved by partially depressing the button 136 (approximately ⅓ of the full travel) and turning the button 136 in a predetermined (clockwise or counter-clockwise) direction. In the lockout mode, the button 136 remains partially depressed serving as visual indication that the tail cap portion 130 is in the lockout mode. In this channel, the button 136 is prevented from being depressed by an internal stop.

When the button 136 is rotated to the lockout mode while the light source 146 is off, the button 136 is prevented from being depressed, and the light source 146 is effectively prevented from being activated.

In various exemplary embodiments, when the button 136 is rotated to the lockout mode while the light source 146 is illuminated, the button 136 is prevented from being depressed, and the light source 146 is effectively prevented from being extinguished.

To disengage the lockout mode, the button 136 is merely rotated in a rotational direction opposite the direction used to engage the lockout mode. Once the button 136 is rotated out of the lockout mode, the button 136 may be freely depressed. In various exemplary embodiments, the rotational force necessary to rotate the button 136 out of the lockout mode is greater than the rotational force necessary to accomplish normal rotation of the button 136.

In an illustrative, non-limiting embodiment of this invention, the lockout mode may be achieved by depressing the button 136 and rotating the button 180°. This places the light in lockout mode. While and lockout mode, the controller continues to poll the switch to determine whether the button 136 has been depressed.

In certain exemplary embodiments, the light source 146 illuminates twice to confirm that the lockout mode has been achieved. Then, to move the light out of the lockout mode, the button 136 is again depressed and rotated 180°. The 180° rotation can be in either direction as the controller, during lockout mode, monitors the number of degrees that the button is rotated and not the direction.

In an illustrative, non-limiting embodiment of this invention, when the light source 146 is on and the battery voltage is decreased to a point at which the controller is unable to maintain the light source 146 at the desired power output, the controller may optionally control the light source 146 to flash off for a brief period of time (approximately microseconds) and then turn back on at the desired power. This may occur approximately every 10 seconds for a predetermined period of time.

In certain exemplary embodiments, if the predetermined period of time expires and the battery voltage is still at a level at which the controller is unable to maintain the light source 146 at the desired power output (i.e., the batteries 160 have not been replaced), the controller may optionally control the light source 146 to operate at a lower power/brightness mode in an effort to extend the amount of time the light source 146 can remain on.

Alternatively, if the battery voltage is decreased to a point at which the controller is unable to maintain the light source 146 at the desired power output, the controller may both control the light source 146 to flash off for a brief period of time and then turn back on at a lower power/brightness mode.

In certain exemplary embodiments, the controller monitors the temperature of the light source 146 and automatically reduces the output of the light source 146 (for example, through pulse width modulation) in an effort to keep the light source 146 from exceeding a predetermined temperature level. If temperature of the light source 146 exceeds a predetermined threshold, the controller may turn the light source 146 off until the temperature of the light source 146 falls below a predetermined threshold.

Figure 13:
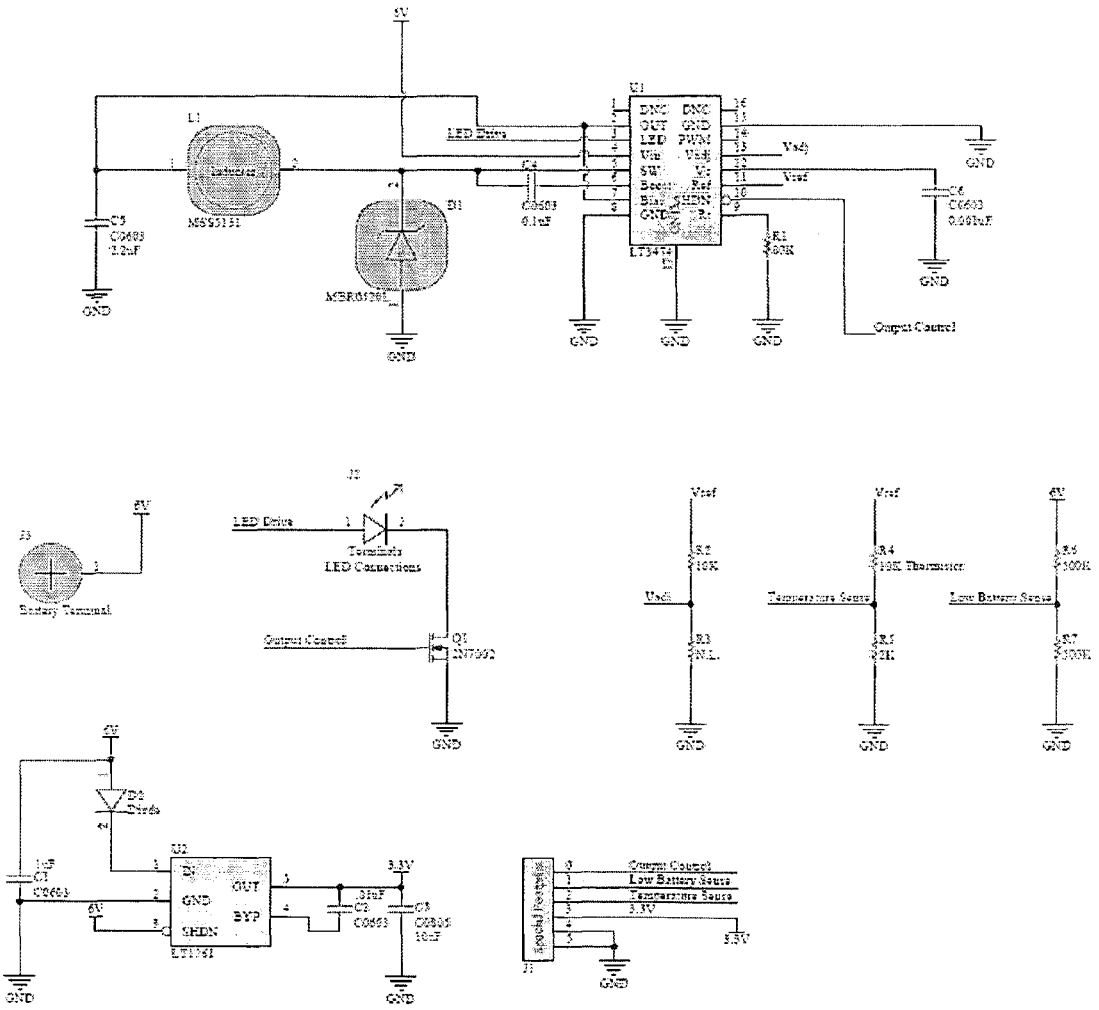
FIG. 13 shows a schematic diagram of an exemplary circuit for use as the light driver circuit according to this invention.

FIG. 13 shows a schematic diagram of an exemplary circuit for use as the light driver circuit according to this invention.

Figure 14:
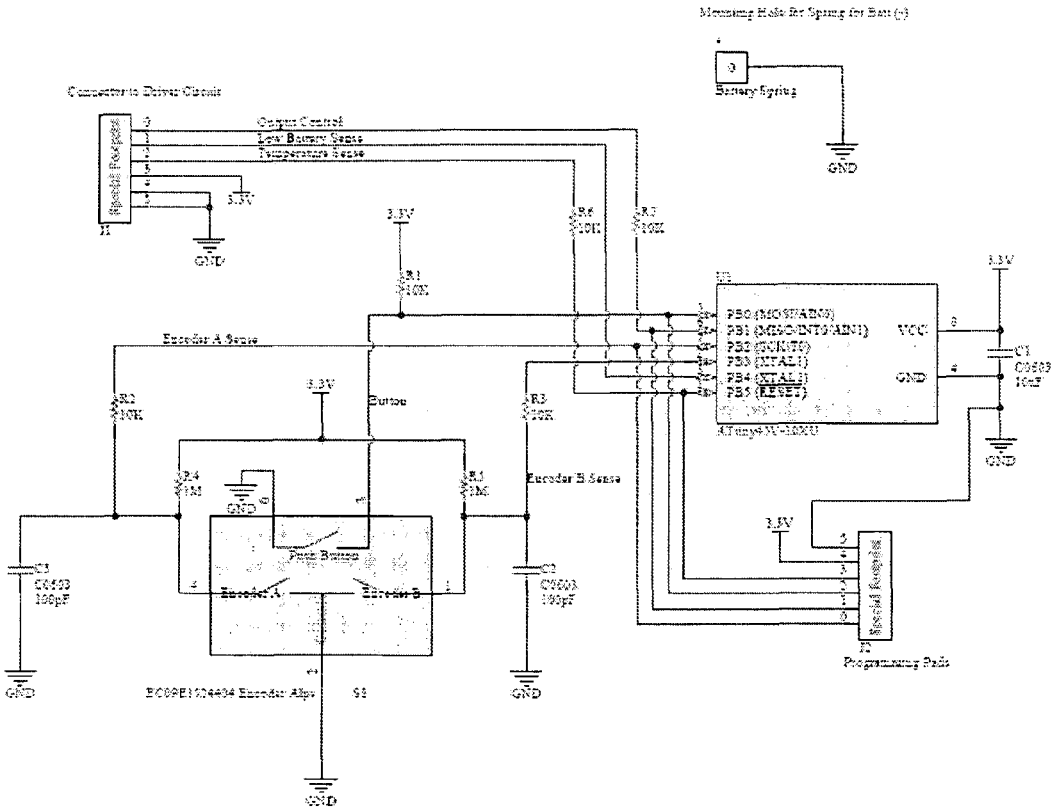
FIG. 14 shows a schematic diagram of an exemplary circuit for use as the switching circuit according to this invention.
Figure 15:
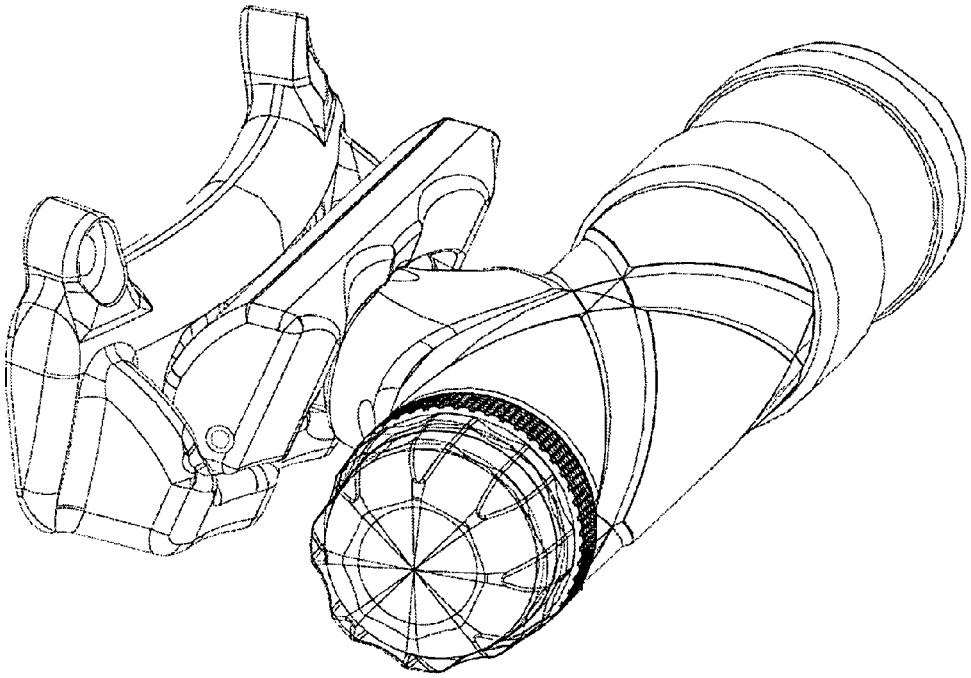
FIGS. 15-19 show the exemplary body sleeve of FIGS. 9A and 9B utilized in connection with a body mounting and/or attachment portion according to this invention.
Figure 16:
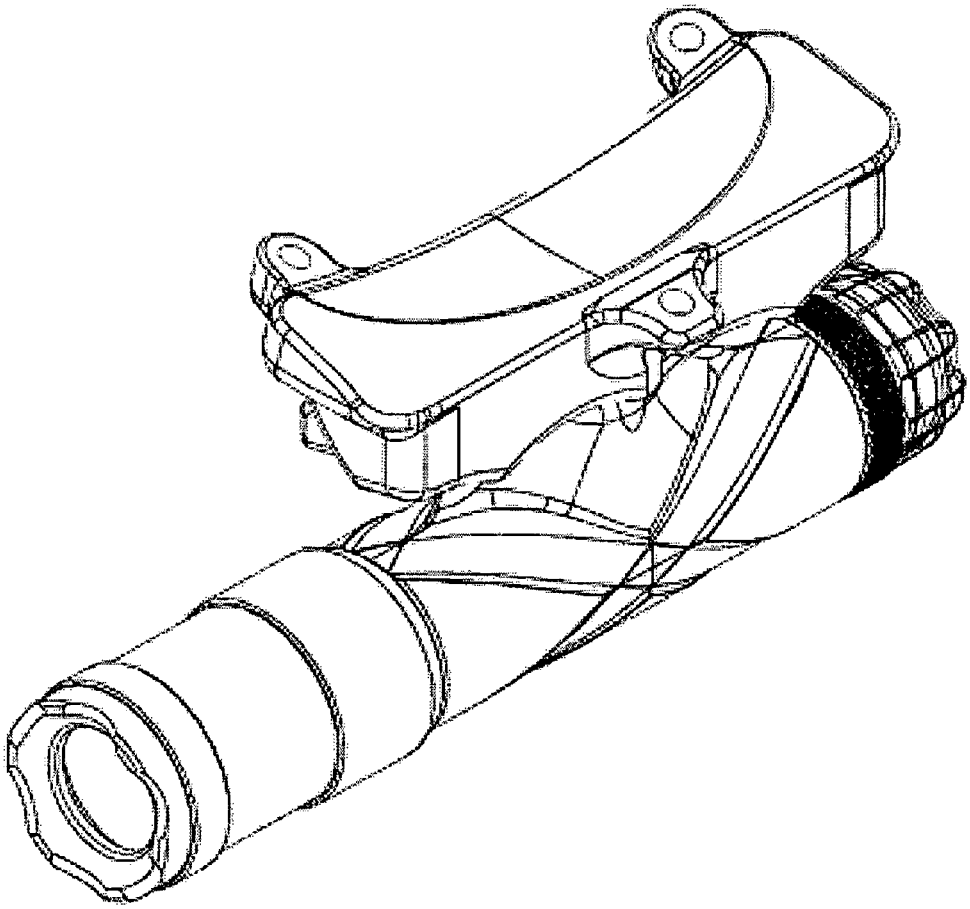
Figure 17:
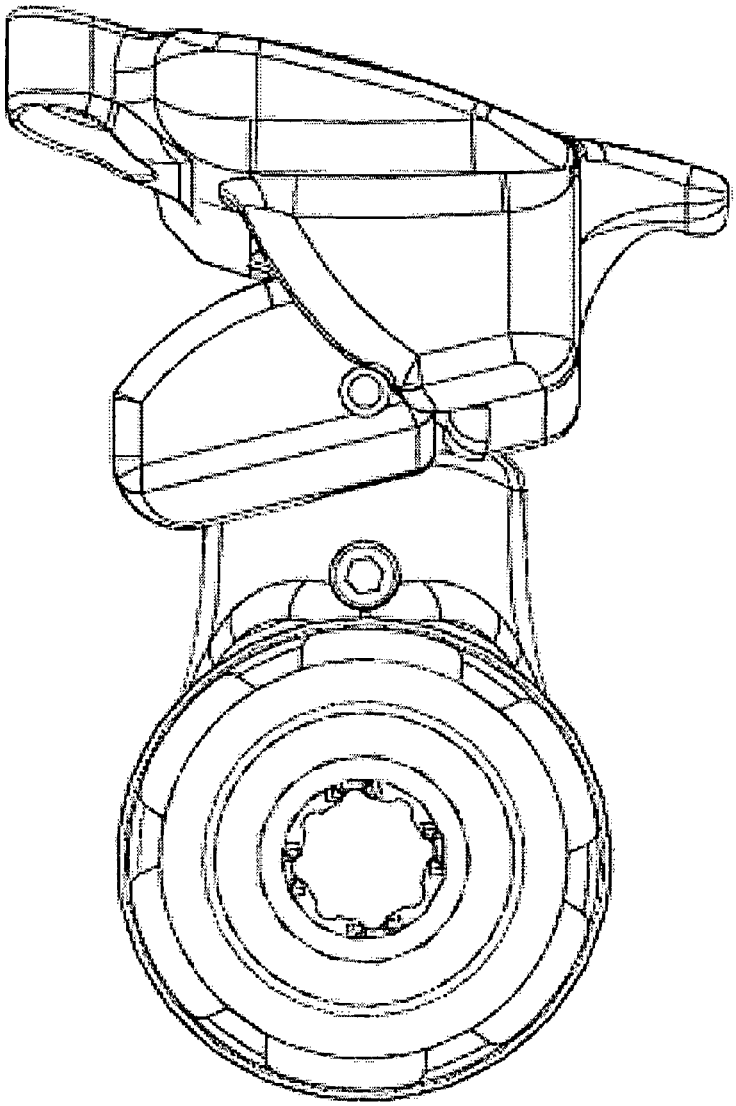
Figure 18:
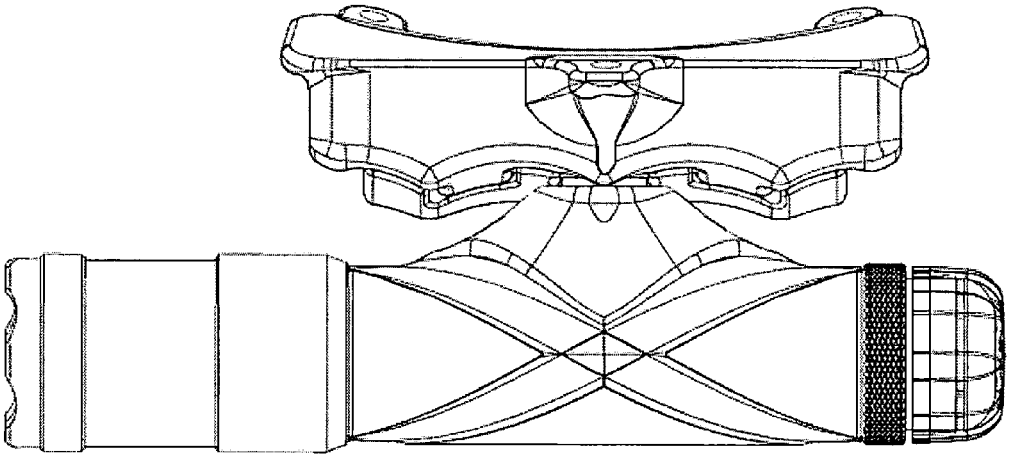
Figure 19:
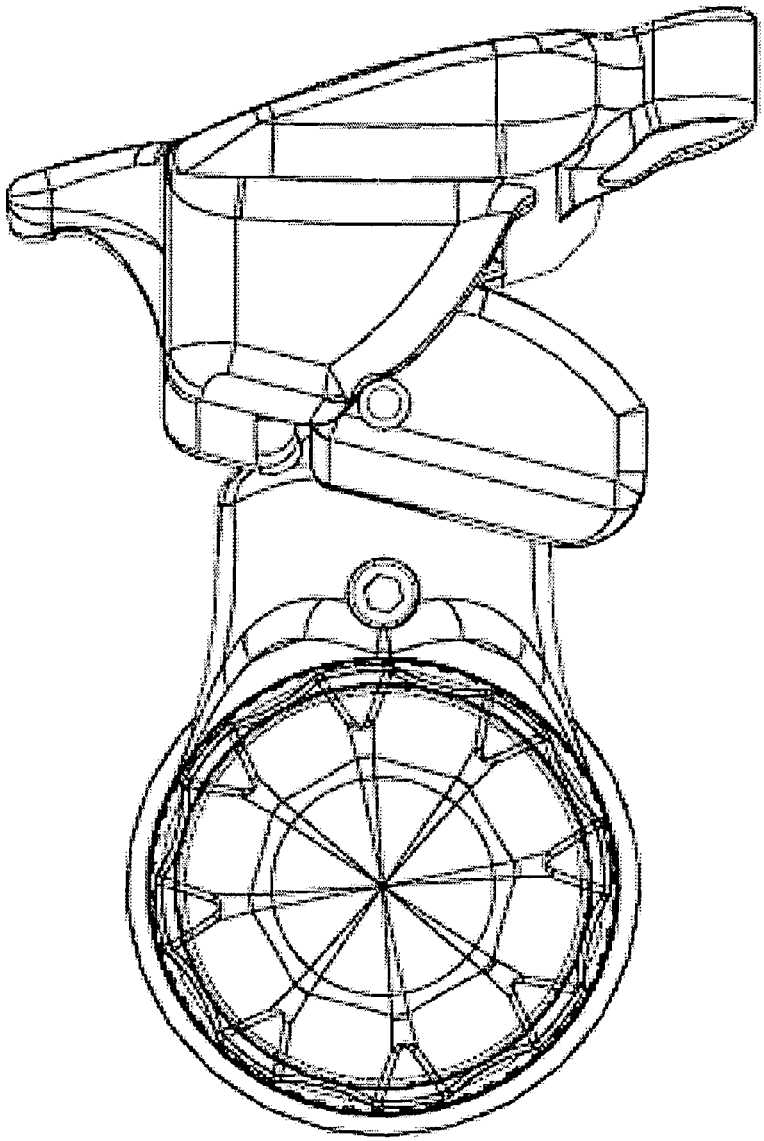

FIG. 14 shows a schematic diagram of an exemplary circuit for use as the switching circuit according to this invention.

In various exemplary embodiments, a capacitor is placed between the LED and the power supply. The capacitor is designed so as to maintain sufficient current to keep the controller active if electrical connection between the power supply and the controller is momentarily lost. In this manner, the affects of jarring and are recoil on the light are reduced.

While this invention has been described in conjunction with the exemplary embodiments outlined above, it is evident that this invention is not limited to particular variations set forth and many alternatives, adaptations, modifications, and variations will be apparent to those skilled in the art. Such alternatives, adaptations, modifications, and variations should and are intended to be comprehended within the meaning and range of equivalents of the disclosed exemplary embodiments and may be substituted without departing from the true spirit and scope of the invention.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either both of those included limits are also included in the invention.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

Also, it is contemplated that any optional feature of the inventive variations described herein may be set forth and claimed independently, or in combination with any one or more of the features described herein.

Accordingly, the foregoing description of the exemplary embodiments of the invention, as set forth above, are intended to be illustrative, not limiting. Various changes, modifications, and/or adaptations may be made without departing from the spirit and scope of this invention.

What is claimed is:

1. A modular illumination device, comprising:

a unitary pushbutton rotary encoder, wherein the pushbutton rotary encoder comprises a unitary button that is depressible and rotatable, wherein rotation of the pushbutton rotary encoder does not generate axial movement of the pushbutton rotary encoder, wherein the unitary button is depressible along and rotatable about the same axis, and wherein if the unitary button is partially depressed and rotated in a predetermined direction the unitary button is prevented from being fully depressed until the unitary button is rotated in a rotational direction opposite the predetermined direction;

a switching circuit, a battery compartment formed so as to accommodate one or more batteries, a negative battery contact, a positive battery contact, a light source, and a light driver circuit that acts as a controller to control various output patterns and on/off functions of the light source, wherein the pushbutton rotary encoder, the switching circuit, the negative battery contact, the positive battery contact, the light source, and the light driver circuit are electrically coupled such that manipulation of the pushbutton rotary encoder can cause the light source to illuminate in a pattern as determined by the light driver circuit;

an inner body portion extending from a first end to a second end and defining an interior cavity;

a head assembly removably attached or coupled to the first end of the inner body portion;

wherein the unitary button, the switching circuit, the battery compartment, the negative battery contact, the positive battery contact, the light source, the light driver circuit, and the head assembly are attached or coupled together so as to form a unitary assembly;

a tail cap portion removably attached or coupled to the second end of the inner body portion, wherein the tail cap portion comprises a rotatable and depressible button, wherein the rotatable and depressible button interacts with the pushbutton rotary encoder, and wherein rotation of the rotatable and depressible button does not generate axial movement of the rotatable and depressible button relative to an axis of the inner body portion; and at least one body sleeve extending from a first end to a second end and defining an interior cavity, wherein the body sleeve is formed so as to accept the inner body portion within the cavity of the body sleeve and to be assembled between the head assembly and the tail cap portion.

2. The modular illumination device of claim 1, wherein the head assembly comprises at least some of a bezel, a reflector, a glass or other lens, and a retaining ring.

3. The modular illumination device of claim 1, wherein the head assembly is permanently affixed to the inner body portion.

4. The modular illumination device of claim 1, wherein the head assembly is formed as an integral portion of the inner body portion.

5. The modular illumination device of claim 1, wherein the tail cap portion is permanently affixed to the inner body portion.

6. The modular illumination device of claim 1, wherein the tail cap portion is formed as an integral portion of the inner body portion.

7. The modular illumination device of claim 1, wherein one or more appropriately sized O-rings are positioned between certain components of the modular illumination device.

8. The modular illumination device of claim 1, wherein rotating a rotatable portion of the rotatable and depressible button to a discrete position selects a distinct functional mode of the modular illumination device and wherein depressing a depressible portion of the rotatable and depressible button activates the selected functional mode.

9. The modular illumination device of claim 8, wherein rotation of the rotatable and depressible button adjusts the intensity of the light source.

10. The modular illumination device of claim 8, wherein the various functional modes of the modular illumination device are implemented as the output of a high current MOSFET acting as a microprocessor controller.

11. The modular illumination device of claim 1, wherein rotating the pushbutton rotary encoder to a discrete position selects a distinct functional mode of the modular illumination device and wherein depressing the pushbutton rotary encoder activates the selected functional mode.

12. The modular illumination device of claim 11, wherein rotation of the pushbutton rotary encoder adjusts the intensity of the light source.

13. The modular illumination device of claim 1, wherein the light driver circuit comprises an integrated circuit.

14. The modular illumination device of claim 1, wherein the light driver circuit comprises a high current MOSFET.

15. The modular illumination device of claim 1, wherein depressing the rotatable and depressible button of the tail cap portion a predetermined number of times within a given time period selects a distinct functional mode of the modular illumination device.

16. The modular illumination device of claim 1, wherein depressing the rotatable and depressible button of the tail cap portion for a predetermined period of time within a given time period selects a distinct functional mode of the modular illumination device.

17. The modular illumination device of claim 1, wherein the light driver circuit can be programmed and/or reprogrammed via a direct or indirect linked connection to a programming and/or reprogramming device.

18. The modular illumination device of claim 1, wherein the light source comprises at least one Light Emitting Diode that is capable of emitting visible or non-visible coherent laser light, or visible or non-visible non-coherent wavelength light.

19. The modular illumination device of claim 1, wherein the light source comprises at least one incandescent illumination device that is capable of emitting visible or non-visible coherent laser light, or visible or non-visible non-coherent wavelength light.

20. The modular illumination device of claim 1, wherein the light source comprises at least one Light Emitting Diode and at least one incandescent illumination device, wherein the at least one Light Emitting Diode and the at least one incandescent illumination device are capable of emitting visible or non-visible coherent laser light, and/or visible or non-visible non-coherent wavelength light.

21. The modular illumination device of claim 1, wherein the inner body portion and the body sleeve include cooperating alignment means such that, once engaged, the body sleeve does not rotate with respect to the inner body portion.

22. The modular illumination device of claim 1, wherein the exterior of the body sleeve includes at least one surface preparation, textured portion, protrusion, intention, groove, flat portion, mounting assembly, clip, rail, grip, or anti-rotation feature.

23. A modular illumination device, comprising:

an electronics assembly, wherein the electronics assembly comprises at least some of a unitary pushbutton encoder, wherein the pushbutton rotary encoder comprises a unitary button that is depressible and rotatable, wherein rotation of the pushbutton rotary encoder does not generate axial movement of the pushbutton rotary encoder, and wherein the unitary button is depressible along and rotatable about the same axis;

a battery compartment formed so as to accommodate one or more batteries, a negative battery contact, a positive battery contact, and a light source, wherein the pushbutton rotary encoder, the switching circuit, the battery compartment, the negative battery contact, the positive battery contact, the light source, and the light driver circuit are combined as an individual unit to form the electronics assembly, wherein the pushbutton rotary encoder is a unitary button that is depressible and/or rotatable, wherein the pushbutton encoder, the negative battery contact, the positive battery contact, and the light source are electrically coupled such that appropriate manipulation of the pushbutton encoder can cause the light source to illuminate, and wherein if the light source is on and a voltage source is unable to maintain the light source at a desired illumination level, the light driver circuit controls the light source to flash on at the desired illumination level and off for several microseconds;

an inner body portion extending from a first end to a second end and defining an interior cavity, wherein the inner body portion is formed so as to accept the electronics assembly within the cavity of the inner body portion;

a head assembly removably attached or coupled to the first end of the inner body portion;

wherein the unitary button, the switching circuit, the battery compartment, the negative battery contact, the positive battery contact, the light source, the light driver circuit, and the head assembly are attached or coupled together so as to form a unitary assembly;

a tail cap portion removably attached or coupled to the second end of the inner body portion, wherein the tail cap portion comprises a rotatable and depressible button, wherein the rotatable and depressible button interacts with the pushbutton encoder, and wherein rotation of the rotatable and depressible button does not generate axial movement of the rotatable and depressible button relative to an axis of the inner body portion; and at least one body sleeve extending from a first end to a second end and defining an interior cavity, wherein the body sleeve is formed so as to accept the inner body portion within the cavity of the body sleeve and to be assembled between the head assembly and the tail cap portion.

24. The modular illumination device of claim 23, wherein the exterior of the body sleeve includes at least one surface preparation, textured portion, protrusion, intention, groove, flat portion, mounting assembly, clip, rail, grip, or anti-rotation feature.

25. A modular illumination device, comprising:

an electronics assembly, wherein the electronics assembly comprises at least some of a unitary pushbutton rotary encoder, wherein the pushbutton rotary encoder comprises a unitary button that is depressible and rotatable, wherein rotation of the pushbutton rotary encoder does not generate axial movement of the pushbutton rotary encoder, and wherein the unitary button is depressible along and rotatable about the same axis, and wherein if the unitary button is partially depressed and rotated in a predetermined direction the unitary button is prevented from being fully depressed until the unitary button is rotated in a rotational direction opposite the predetermined direction;

a switching circuit, a battery compartment formed so as to accommodate one or more batteries, a negative battery contact, a positive battery contact, a light source, and a light driver circuit that acts as a controller to control various output patterns and on/off functions of the light source, wherein the pushbutton rotary encoder, the switching circuit, the battery compartment, the negative battery contact, the positive battery contact, the light source, and the light driver circuit are combined as an individual unit to form the electronics assembly, wherein the pushbutton rotary encoder is a unitary button that is depressible and/or rotatable, and wherein the pushbutton rotary encoder, the switching circuit, the negative battery contact, the positive battery contact, the light source, and the light driver circuit are electrically coupled such that appropriate manipulation of the pushbutton rotary encoder can cause the light source to illuminate in a pattern as determined by the light driver circuit;

an inner body portion extending from a first end to a second end and defining an interior cavity, wherein the inner body portion is formed so as to accept the electronics assembly within the cavity of the inner body portion;

a body sleeve extending from a first end to a second end and defining an interior cavity, wherein the body sleeve is formed so as to accept the inner body portion within the cavity of the body sleeve;

a head assembly removably attached or coupled to the first end of the body sleeve;

wherein the unitary button, the switching circuit, the battery compartment, the negative battery contact, the positive battery contact, the light source, the light driver circuit, and the head assembly are attached or coupled together so as to form a unitary assembly; and a tail cap portion removably attached or coupled to the second end of the body sleeve, wherein the tail cap portion comprises a rotatable and depressible button, wherein the rotatable and depressible button interacts with the pushbutton rotary encoder, and wherein rotation of the rotatable and depressible button does not generate axial movement of the rotatable and depressible button relative to an axis of the inner body portion.

26. The modular illumination device of claim 25, wherein the exterior of the body sleeve includes at least one surface preparation, textured portion, protrusion, intention, groove, flat portion, mounting assembly, clip, rail, grip, or anti-rotation feature.

* * * * *